US011505754B2

(12) United States Patent
Akah et al.

(10) Patent No.: US 11,505,754 B2
(45) Date of Patent: Nov. 22, 2022

(54) PROCESSES FOR PRODUCING PETROCHEMICAL PRODUCTS FROM ATMOSPHERIC RESIDUES

(71) Applicant: Saudi Arabian Oil Company, Dhahran (SA)

(72) Inventors: Aaron Chi Akah, Dhahran (SA); Musaed Salem Al-Ghrami, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/009,022

(22) Filed: Sep. 1, 2020

(65) Prior Publication Data

US 2022/0064551 A1 Mar. 3, 2022

(51) Int. Cl.
*C10G 69/04* (2006.01)

(52) U.S. Cl.
CPC ..... *C10G 69/04* (2013.01); *C10G 2300/107* (2013.01); *C10G 2300/202* (2013.01); *C10G 2300/205* (2013.01); *C10G 2300/308* (2013.01); *C10G 2300/701* (2013.01); *C10G 2300/807* (2013.01); *C10G 2400/20* (2013.01); *C10G 2400/22* (2013.01)

(58) Field of Classification Search
None
See application file for complete search history.

(56) References Cited

U.S. PATENT DOCUMENTS

| | | | |
|---|---|---|---|
| 977,228 | A | 11/1910 | Schestopol |
| 2,882,218 | A | 4/1959 | Jewell |
| 3,074,878 | A | 1/1963 | Pappas |
| 3,835,029 | A | 9/1974 | Larson |
| 3,837,822 | A | 9/1974 | Ward |
| 3,856,659 | A | 12/1974 | Owen |
| 3,888,762 | A | 6/1975 | Gerhold |
| 4,090,949 | A | 5/1978 | Owen et al. |
| 4,297,203 | A | 10/1981 | Ford et al. |
| 4,417,975 | A | 11/1983 | Myers |

(Continued)

FOREIGN PATENT DOCUMENTS

| | | | |
|---|---|---|---|
| CN | 1710029 | A | 12/2005 |
| CN | 102925210 | A | 2/2013 |

(Continued)

OTHER PUBLICATIONS

International Search Report and Written Opinion dated May 3, 2021 pertaining to International application No. PCT/US2021/015012 filed Jan. 26, 2021, 12 pages.

(Continued)

*Primary Examiner* — Tam M Nguyen
(74) *Attorney, Agent, or Firm* — Dinsmore & Shol LLP

(57) ABSTRACT

According to one or more embodiments, petrochemical products may be formed from a hydrocarbon material by a method that includes separating crude oil into at least two or more fractions in an atmospheric distillation column, hydrotreating the atmospheric residue to form a hydrotreated atmospheric residue, combining steam with the hydrotreated atmospheric residue, and cracking at least a portion of the hydrotreated atmospheric residue in the presence of a first catalyst to produce a cracking reaction product.

18 Claims, 3 Drawing Sheets

(56) References Cited

U.S. PATENT DOCUMENTS

| | | | |
|---|---|---|---|
| 4,419,221 | A | 12/1983 | Castagnos et al. |
| 4,436,613 | A | 3/1984 | Sayles et al. |
| 4,464,250 | A | 8/1984 | Myers et al. |
| 4,606,810 | A | 8/1986 | Krambeck et al. |
| 4,830,728 | A | 5/1989 | Herbst et al. |
| 4,980,053 | A | 12/1990 | Li et al. |
| 4,992,160 | A | 2/1991 | Long et al. |
| 5,026,935 | A | 6/1991 | Leyshon et al. |
| 5,026,936 | A | 6/1991 | Leyshon et al. |
| 5,043,522 | A | 8/1991 | Leyshon et al. |
| 5,154,818 | A | 10/1992 | Harandi et al. |
| 5,158,919 | A | 10/1992 | Haddad et al. |
| 5,160,424 | A | 11/1992 | Le et al. |
| 5,171,921 | A | 12/1992 | Gaffney et al. |
| 5,232,580 | A | 8/1993 | Le et al. |
| 5,232,675 | A | 8/1993 | Shu et al. |
| 5,318,689 | A | 6/1994 | Hsing et al. |
| 5,326,465 | A | 7/1994 | Yongqing et al. |
| 5,334,554 | A | 8/1994 | Lin et al. |
| 5,372,704 | A | 12/1994 | Harandi et al. |
| 5,380,690 | A | 1/1995 | Zhicheng et al. |
| 5,451,313 | A | 9/1995 | Wegerer et al. |
| 5,462,652 | A | 10/1995 | Wegerer |
| 5,523,502 | A | 6/1996 | Rubin |
| 5,549,813 | A | 8/1996 | Dai et al. |
| 5,589,139 | A | 12/1996 | Zinke et al. |
| 5,597,537 | A | 1/1997 | Wegerer et al. |
| 5,637,207 | A | 6/1997 | Hsing et al. |
| 5,670,037 | A | 9/1997 | Zaiting et al. |
| 5,685,972 | A | 11/1997 | Timken et al. |
| 5,730,859 | A | 3/1998 | Johnson et al. |
| 5,770,042 | A | 6/1998 | Galperin et al. |
| 5,858,207 | A | 1/1999 | Lomas |
| 5,904,837 | A | 5/1999 | Fujiyama |
| 5,951,850 | A | 9/1999 | Ino et al. |
| 5,976,356 | A | 11/1999 | Drake et al. |
| 5,993,642 | A | 11/1999 | Mohr et al. |
| 6,015,933 | A | 1/2000 | Abrevaya et al. |
| 6,069,287 | A | 5/2000 | Ladwig et al. |
| 6,210,562 | B1 | 4/2001 | Xie et al. |
| 6,287,522 | B1 | 9/2001 | Lomas |
| 6,288,298 | B1 | 9/2001 | Rodriguez et al. |
| 6,300,537 | B1 | 10/2001 | Strohmaier et al. |
| 6,315,890 | B1 | 11/2001 | Ladwig et al. |
| 6,420,621 | B2 | 7/2002 | Sha et al. |
| 6,455,750 | B1 | 9/2002 | Steffens et al. |
| 6,521,563 | B2 | 2/2003 | Strohmaier et al. |
| 6,548,725 | B2 | 4/2003 | Froment et al. |
| 6,566,293 | B1 | 5/2003 | Vogt et al. |
| 6,602,403 | B1 | 8/2003 | Steffens et al. |
| 6,652,737 | B2 | 11/2003 | Touvelle et al. |
| 6,656,345 | B1 | 12/2003 | Chen et al. |
| 6,656,346 | B2 | 12/2003 | Ino et al. |
| 6,784,329 | B2 | 8/2004 | O'Rear et al. |
| 6,867,341 | B1 | 3/2005 | Abrevaya et al. |
| 6,979,755 | B2 | 12/2005 | O'Rear et al. |
| 7,019,187 | B2 | 3/2006 | Powers |
| 7,029,571 | B1 | 4/2006 | Bhattacharyya et al. |
| 7,087,154 | B2 | 8/2006 | Pinho et al. |
| 7,087,155 | B1 | 8/2006 | Dath et al. |
| 7,128,827 | B2 | 10/2006 | Tallman et al. |
| 7,153,479 | B2 | 12/2006 | Peterson et al. |
| 7,169,293 | B2 | 1/2007 | Lomas et al. |
| 7,220,351 | B1 | 5/2007 | Pontier et al. |
| 7,261,807 | B2 | 8/2007 | Henry et al. |
| 7,270,739 | B2 | 9/2007 | Chen et al. |
| 7,312,370 | B2 | 12/2007 | Pittman et al. |
| 7,314,964 | B2 | 1/2008 | Abrevaya et al. |
| 7,326,332 | B2 | 2/2008 | Chen et al. |
| 7,374,660 | B2 | 5/2008 | Steffens et al. |
| 7,459,596 | B1 | 12/2008 | Abrevaya et al. |
| 7,479,218 | B2 | 1/2009 | Letzsch |
| 7,686,942 | B2 | 3/2010 | Xie et al. |
| 7,906,077 | B2 | 3/2011 | Sandacz |
| 7,935,654 | B2 | 5/2011 | Choi et al. |
| 8,137,533 | B2 | 3/2012 | Towler et al. |
| 8,247,631 | B2 | 8/2012 | Nicholas et al. |
| 8,614,160 | B2 | 12/2013 | Upson et al. |
| 8,864,979 | B2 | 10/2014 | Palmas |
| 8,933,286 | B2 | 1/2015 | Souza et al. |
| 9,096,806 | B2 | 8/2015 | Abba et al. |
| 9,101,854 | B2 | 8/2015 | Koseoglu et al. |
| 9,290,705 | B2 | 3/2016 | Bourane et al. |
| 9,783,749 | B2 | 10/2017 | Davydov |
| 9,816,037 | B2 | 11/2017 | Avais |
| 2001/0042700 | A1 | 11/2001 | Swan, III et al. |
| 2001/0056217 | A1 | 12/2001 | Froment et al. |
| 2002/0003103 | A1 | 1/2002 | Henry et al. |
| 2003/0220530 | A1 | 11/2003 | Boelt et al. |
| 2005/0070422 | A1 | 3/2005 | Chen et al. |
| 2005/0150817 | A1 | 7/2005 | Tallman et al. |
| 2006/0108260 | A1 | 5/2006 | Henry |
| 2008/0011644 | A1 | 1/2008 | Dean et al. |
| 2008/0011645 | A1 | 1/2008 | Dean |
| 2008/0035527 | A1 | 2/2008 | Eng et al. |
| 2008/0044611 | A1 | 2/2008 | Husemann et al. |
| 2009/0012339 | A1 | 1/2009 | Choi et al. |
| 2009/0112035 | A1 | 4/2009 | Choi et al. |
| 2009/0288990 | A1 | 11/2009 | Xie et al. |
| 2011/0139679 | A1 | 6/2011 | Bories et al. |
| 2012/0241359 | A1 | 9/2012 | Al-Thubaiti et al. |
| 2013/0001130 | A1 | 1/2013 | Mo |
| 2013/0056393 | A1 | 3/2013 | Subramani et al. |
| 2013/0172643 | A1 | 7/2013 | Pradeep et al. |
| 2013/0248420 | A1 | 9/2013 | Palmas |
| 2013/0248421 | A1 | 9/2013 | Abba et al. |
| 2014/0110308 | A1 | 4/2014 | Bourane et al. |
| 2014/0228205 | A1 | 8/2014 | Narayanaswamy et al. |
| 2015/0094511 | A1 | 4/2015 | Bastianti et al. |
| 2016/0333280 | A1 | 11/2016 | Subramani et al. |
| 2017/0130140 | A1 | 5/2017 | Bhanuprasad et al. |
| 2017/0190991 | A1 | 7/2017 | Sundberg et al. |
| 2018/0057758 | A1 | 3/2018 | Al-Ghamdi et al. |
| 2018/0079974 | A1 | 3/2018 | Kokayeff et al. |
| 2018/0142167 | A1 | 5/2018 | Al-Ghamdi et al. |
| 2018/0223193 | A1 | 8/2018 | Kukade et al. |
| 2018/0305623 | A1 | 10/2018 | Al-Ghrami et al. |
| 2018/0327677 | A1 | 11/2018 | Ding et al. |
| 2018/0346827 | A1 | 12/2018 | Al-Ghamdi et al. |
| 2019/0119586 | A1 | 4/2019 | Gong et al. |
| 2019/0225894 | A1 | 7/2019 | Bourane et al. |
| 2020/0255753 | A1 | 8/2020 | Al-Herz et al. |
| 2020/0283688 | A1* | 9/2020 | Long ..... C10G 21/003 |
| 2021/0047573 | A1 | 2/2021 | Bourane et al. |

FOREIGN PATENT DOCUMENTS

| | | | |
|---|---|---|---|
| EP | 315179 | A4 | 5/1989 |
| EP | 2688982 | A1 | 1/2014 |
| GB | 978576 | | 12/1964 |
| WO | 2010053482 | A1 | 5/2010 |
| WO | 2012128973 | A1 | 9/2012 |
| WO | 2016096502 | A1 | 6/2016 |
| WO | 2016096970 | A1 | 6/2016 |
| WO | 2019106921 | A1 | 6/2019 |

OTHER PUBLICATIONS

International Search Report and Written Opinion dated May 3, 2021 pertaining to International application No. PCT/US2021/015007 filed Jan. 26, 2021, 15 pages.

International Search Report and Written Opinion dated May 3, 2021 pertaining to International application No. PCT/US2021/015010 filed Jan. 26, 2021, 13 pages.

Office Action dated Jun. 7, 2021 pertaining to U.S. Appl. No. 17/009,008, filed Sep. 1, 2020, 28 pages.

International Search Report and Written Opinion dated May 10, 2021 pertaining to International application No. PCT/US2021/015013 filed Jan. 26, 2021, 14 pages.

International Search Report and Written Opinion dated May 10, 2021 pertaining to International application No. PCT/US2021/015035 filed Jan. 26, 2021, 15 pages.

(56) References Cited

OTHER PUBLICATIONS

International Search Report and Written Opinion dated May 10, 2021 pertaining to International application No. PCT/US2021/015019 filed Jan. 26, 2021, 15 pages.
Office Action dated Jun. 8, 2021 pertaining to U.S. Appl. No. 17/009,048, filed Sep. 1, 2020, 28 pages.
Office Action dated Jun. 10, 2021 pertaining to U.S. Appl. No. 17/009,039, filed Sep. 1, 2020, 39 pages.
Office Action dated May 26, 2021 pertaining to U.S. Appl. No. 17/009,012, filed Sep. 1, 2020, 37 pages.
Office Action dated Mar. 16, 2021 pertaining to U.S. Appl. No. 17/009,073, filed Sep. 1, 2020, 27 pgs.
Corma, "A new continuous laboratory reactor for the study of catalytic cracking", Applied Catalysis A: General 232, pp. 247-263, 2002.
International Search Report and Written Opinion pertaining to International Application PCT/US2018/030858 dated May 3, 2018.
Corma et al., "Different process schemes for converting light straight run and fluid catalytic cracing naphthas in a FCC unit for maximum propylene production", Applied Catalyst A: General 265, pp. 195-206, 2004.
Verstraete et al., "Study of direct and indirect naphtha recycling to a resid FCC unit for maximum propylene production", Catalysis Today, 106, pp. 62-71, 2005.
International Search Report and Written Opinion dated Apr. 4, 2019 pertaining to International application No. PCT/US2019/013978 filed Jan. 17, 2019, 19 pgs.
Corma et al., "Steam catalytic cracking of naphtha over ZSM-5 zeolite for production of propene and ethene: Micro and mascroscopic implications of the presence of steam", Applied Catalysis A: General 417-418, pp. 220-235, 2012.
Examination Report pertaining to Application No. GC2018-35391 dated Nov. 27, 2019.
Office Action dated Nov. 15, 2019 pertaining to U.S. Appl. No. 16/244,181, filed Jan. 10, 2019, 41 pgs.
Office Action dated May 13, 2020 pertaining to U.S. Appl. No. 15/945,362, filed Apr. 4, 2018, 55 pgs.
Office Action dated May 26, 2020 pertaining to U.S. Appl. No. 16/244,181, filed Jan. 10, 2019, 22 pgs.
Notice of Allowance dated Aug. 19, 2020 pertaining to U.S. Appl. No. 15/945,362, filed Apr. 4, 2018, 9 pgs.
Notice of Allowance dated Sep. 4, 2020 pertaining to U.S. Appl. No. 16/244,181, filed Jan. 10, 2019, 15 pgs.
International Search Report and Written Opinion dated Jun. 16, 2021 pertaining to International application No. PCT/US2021/015030 filed Jan. 26, 2021, 15 pages.
Office Action dated Jul. 6, 2021 pertaining to U.S. Appl. No. 17/009,020, filed Sep. 1, 2020, 41 pages.
Office Action dated Jul. 2, 2021 pertaining to U.S. Appl. No. 17/009,073, filed Sep. 1, 2020, 18 pages.

* cited by examiner

PROCESSES FOR PRODUCING PETROCHEMICAL PRODUCTS FROM ATMOSPHERIC RESIDUES

TECHNICAL FIELD

Embodiments of the present disclosure generally relate to chemical processing and, more specifically, to processes and systems utilizing fluid catalytic cracking to form olefins.

BACKGROUND

Ethylene, propene, butene, butadiene, and aromatics compounds such as benzene, toluene and xylenes are basic intermediates for a large proportion of the petrochemical industry. They are usually obtained through the thermal cracking (or steam pyrolysis) of petroleum gases and distillates such as naphtha, kerosene or even gas oil. These compounds are also produced through a refinery fluidized catalytic cracking (FCC) process where classical heavy feedstocks such as gas oils or residues are converted. Typical FCC feedstocks range from hydrocracked bottoms to heavy feed fractions such as vacuum gas oil and atmospheric residue; however, these feedstocks are limited. The second most important source for propene production is currently refinery propene from FCC units. With the ever growing demand, FCC unit owners look increasingly to the petrochemicals market to boost their revenues by taking advantage of economic opportunities that arise in the propene market.

The worldwide increasing demand for light olefins remains a major challenge for many integrated refineries. In particular, the production of some valuable light olefins such as ethylene, propene, and butene has attracted increased attention as pure olefin streams are considered the building blocks for polymer synthesis. The production of light olefins depends on several process variables like the feed type, operating conditions, and the type of catalyst.

SUMMARY

Despite the options available for producing a greater yield of propene and other light olefins, intense research activity in this field is still being conducted. These options include the use of high severity fluid catalytic cracking ("HSFCC") systems, developing more selective catalysts for the process, and enhancing the configuration of the process in favor of more advantageous reaction conditions and yields. In some embodiments, the HSFCC process is capable of producing yields of propene up to four times greater than the traditional fluid catalytic cracking unit and greater conversion levels for a range of petroleum streams. Embodiments of the present disclosure are directed to improved FCC systems and processes for producing one or more petrochemical products from atmospheric residues. By the presently disclosed embodiments, atmosphere residues may be directly converted to valuable chemical feedstocks, such as light olefins. The use of steam in combination with the atmospheric residue may allow for greater yields of light olefins when cracked in an HSFCC unit.

According to one or more embodiments, petrochemical products may be formed from hydrocarbon materials by a method that comprises separating crude oil into at least two or more fractions in an atmospheric distillation column (wherein one of the fractions may be an atmospheric residue), hydrotreating the atmospheric residue to form a hydrotreated atmospheric residue, combining steam with the hydrotreated atmospheric residue such that the partial pressure of the hydrotreated atmospheric residue is reduced, and cracking at least a portion of the hydrotreated atmospheric residue in the presence of a first catalyst at a reaction temperature of from 500° C. to 700° C. to produce a cracking reaction product.

According to one or more additional embodiments, petrochemical product streams may be formed from hydrocarbon materials by a method that comprises separating a crude oil stream into at least two or more fractions in an atmospheric distillation column (wherein one of the fractions is an atmospheric residue stream), hydrotreating the atmospheric residue stream to form a hydrotreated atmospheric residue stream, combining steam with the hydrotreated atmospheric residue stream such that the partial pressure of the hydrocarbons in the hydrotreated atmospheric residue stream is reduced, and cracking at least a portion of the hydrotreated atmospheric residue stream in the presence of a first catalyst at a reaction temperature of from 500° C. to 700° C. to produce a cracking reaction product stream.

Additional features and advantages of the described embodiments will be set forth in the detailed description which follows, and in part will be readily apparent to those skilled in the art from that description or recognized by practicing the described embodiments, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Figure 1:
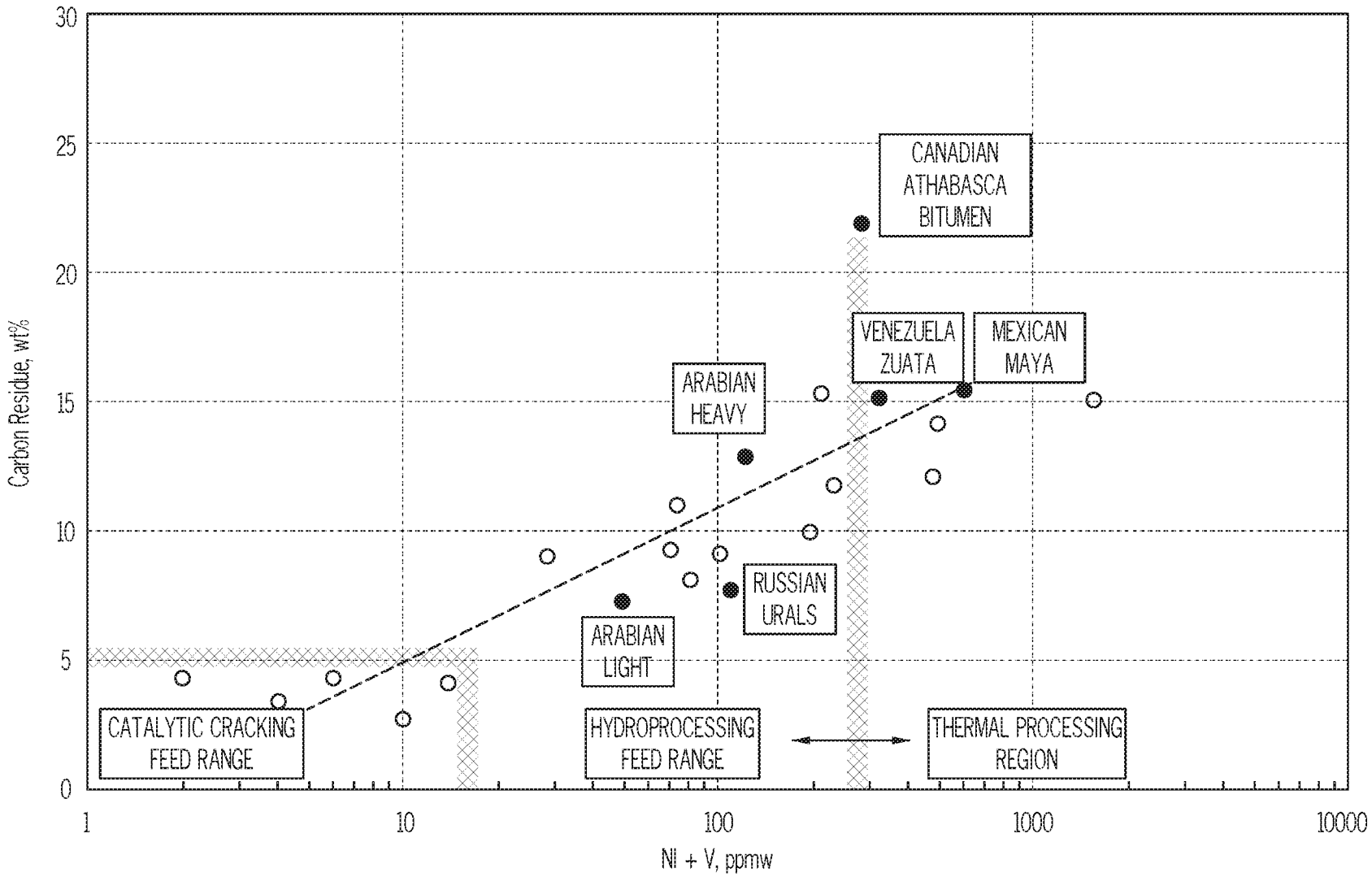
FIG. 1 graphically depicts relative properties of various hydrocarbon feed streams used for producing one or more petrochemical products, according to one or more embodiments described in this disclosure.

For the purpose of describing the simplified schematic illustrations and descriptions of the relevant figures, the numerous valves, temperature sensors, electronic controllers and the like that may be employed and well known to those of ordinary skill in the art of certain chemical processing operations are not included. Further, accompanying components that are often included in typical chemical processing operations, such as air supplies, catalyst hoppers, and flue gas handling systems, are not depicted. Accompanying components that are in hydrocracking units, such as bleed streams, spent catalyst discharge subsystems, and catalyst replacement sub-systems are also not shown. It should be understood that these components are within the spirit and scope of the present embodiments disclosed. However, operational components, such as those described in the present disclosure, may be added to the embodiments described in this disclosure.

It should further be noted that arrows in the drawings refer to process streams. However, the arrows may equivalently refer to transfer lines which may serve to transfer process streams between two or more system components. Additionally, arrows that connect to system components define inlets or outlets in each given system component. The arrow direction corresponds generally with the major direction of movement of the materials of the stream contained within the physical transfer line signified by the arrow. Furthermore, arrows which do not connect two or more system components signify a product stream which exits the depicted system or a system inlet stream which enters the depicted system. Product streams may be further processed in accompanying chemical processing systems or may be commercialized as end products. System inlet streams may be streams transferred from accompanying chemical processing systems or may be non-processed feedstock streams. Some arrows may represent recycle streams, which are effluent streams of system components that are recycled back into the system. However, it should be understood that any represented recycle stream, in some embodiments, may be replaced by a system inlet stream of the same material, and that a portion of a recycle stream may exit the system as a system product.

Additionally, arrows in the drawings may schematically depict process steps of transporting a stream from one system component to another system component. For example, an arrow from one system component pointing to another system component may represent "passing" a system component effluent to another system component, which may include the contents of a process stream "exiting" or being "removed" from one system component and "introducing" the contents of that product stream to another system component.

It should be understood that according to the embodiments presented in the relevant figures, an arrow between two system components may signify that the stream is not processed between the two system components. In other embodiments, the stream signified by the arrow may have substantially the same composition throughout its transport between the two system components. Additionally, it should be understood that in one or more embodiments, an arrow may represent that at least 75 wt. %, at least 90 wt. %, at least 95 wt. %, at least 99 wt. %, at least 99.9 wt. %, or even 100 wt. % of the stream is transported between the system components. As such, in some embodiments, less than all of the stream signified by an arrow may be transported between the system components, such as if a slip stream is present.

It should be understood that two or more process streams are "mixed" or "combined" when two or more lines intersect in the schematic flow diagrams of the relevant figures. Mixing or combining may also include mixing by directly introducing both streams into a like reactor, separation device, or other system component. For example, it should be understood that when two streams are depicted as being combined directly prior to entering a separation unit or reactor, that in some embodiments the streams could equivalently be introduced into the separation unit or reactor and be mixed in the reactor.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

One or more embodiments of the present disclosure are directed to systems and processes for converting one or more hydrocarbon feed streams into one or more petrochemical products using a high-severity fluidized catalytic cracking (HSFCC) system that include at least a downflow fluid catalytic cracking (FCC) unit operated at high-severity conditions. For example, a method for operating a system having an FCC unit may include separating the hydrocarbon feed stream into an atmospheric residue stream and other lighter streams. The atmospheric residue stream may be introduced to a hydrotreating unit where it is hydrotreated. The hydrotreated atmospheric residue stream may then be passed to the FCC unit where products are formed. The products may be transferred to a separation device, where cycle oil is separated from other products. The cycle oil may be recycled by passing it to the hydrotreating unit. In the embodiments of the present disclosure, steam may be combined with the hydrotreated atmospheric residue prior to it entering the FCC unit.

As used in this disclosure, a "reactor" refers to a vessel in which one or more chemical reactions may occur between one or more reactants optionally in the presence of one or more catalysts. For example, a reactor may include a tank or tubular reactor configured to operate as a batch reactor, a continuous stirred-tank reactor (CSTR), or a plug flow reactor. Example reactors include packed bed reactors such as fixed bed reactors, and fluidized bed reactors. One or more "reaction zones" may be disposed in a reactor. As used in this disclosure, a "reaction zone" refers to an area where a particular reaction takes place in a reactor. For example, a packed bed reactor with multiple catalyst beds may have multiple reaction zones, where each reaction zone is defined by the area of each catalyst bed.

As used in this disclosure, a "separation unit" refers to any separation device or system of separation devices that at least partially separates one or more chemicals that are mixed in a process stream from one another. For example, a separation unit may selectively separate differing chemical species, phases, or sized material from one another, forming one or more chemical fractions. Examples of separation units include, without limitation, distillation columns, flash drums, knock-out drums, knock-out pots, centrifuges, cyclones, filtration devices, traps, scrubbers, expansion devices, membranes, solvent extraction devices, and the like. It should be understood that separation processes described in this disclosure may not completely separate all of one chemical constituent from all of another chemical constituent. It should be understood that the separation processes described in this disclosure "at least partially" separate different chemical components from one another, and that even if not explicitly stated, it should be understood that separation may include only partial separation. As used in this disclosure, one or more chemical constituents may be "separated" from a process stream to form a new process stream. Generally, a process stream may enter a separation unit and be divided, or separated, into two or more process streams of desired composition. Further, in some separation processes, a "lesser boiling point fraction" (sometimes referred to as a "light fraction") and a "greater boiling point fraction" (sometimes referred to as a "heavy fraction") may exit the separation unit, where, on average, the contents of the lesser boiling point fraction stream have a lesser boiling point than the greater boiling point fraction stream. Other streams may fall between the lesser boiling point fraction and the greater boiling point fraction, such as an "intermediate boiling point fraction."

As used in this disclosure, the term "high-severity conditions" generally refers to FCC temperatures of 500° C. or greater, a weight ratio of catalyst to hydrocarbon (catalyst to oil ratio) of equal to or greater than 5:1, and a residence time of less than 3 seconds, all of which may be more severe than typical FCC reaction conditions.

It should be understood that an "effluent" generally refers to a stream that exits a system component such as a separation unit, a reactor, or reaction zone, following a particular reaction or separation, and generally has a different composition (at least proportionally) than the stream that entered the separation unit, reactor, or reaction zone.

As used in this disclosure, a "catalyst" refers to any substance that increases the rate of a specific chemical reaction. Catalysts described in this disclosure may be utilized to promote various reactions, such as, but not limited to, cracking (including aromatic cracking), demetalization, desulfurization, and denitrogenation. As used in this disclosure, "cracking" generally refers to a chemical reaction where carbon-carbon bonds are broken. For example, a molecule having carbon to carbon bonds is broken into more than one molecule by the breaking of one or more of the carbon to carbon bonds, or is converted from a compound which includes a cyclic moiety, such as a cycloalkane, cycloalkane, naphthalene, an aromatic or the like, to a compound which does not include a cyclic moiety or contains fewer cyclic moieties than prior to cracking.

As used in this disclosure, the term "FCC catalyst" refers to catalyst that is introduced to the cracking reaction zone, such as the FCC catalyst passed from the catalyst/feed mixing zone to the cracking reaction zone. The FCC catalyst may include at least one of regenerated catalyst, spent first catalyst, spent FCC catalyst, fresh catalyst, or combinations of these. As used in this disclosure, the term "FCC catalyst" refers to catalyst that is introduced to the second cracking reaction zone, such as the catalyst passed from the FCC catalyst/feed mixing zone to the second cracking reaction zone for example. The FCC catalyst may include at least one of regenerated catalyst, spent first catalyst, spent FCC catalyst, fresh catalyst, or combinations of these.

As used in this disclosure, the term "spent FCC catalyst" refers to catalyst that has been introduced to and passed through a cracking reaction zone to crack a hydrocarbon material, such as the greater boiling point fraction or the lesser boiling point fraction for example, but has not been regenerated in the regenerator following introduction to the cracking reaction zone. The "spent FCC catalyst" may have coke deposited on the catalyst and may include partially coked catalyst as well as fully coked catalysts. The amount of coke deposited on the "spent FCC catalyst" may be greater than the amount of coke remaining on the regenerated catalyst following regeneration.

As used in this disclosure, the term "regenerated FCC catalyst" refers to catalyst that has been introduced to a cracking reaction zone and then regenerated in a regenerator to heat the FCC catalyst to a greater temperature, oxidize and remove at least a portion of the coke from the FCC catalyst to restore at least a portion of the catalytic activity of the catalyst, or both. The "regenerated FCC catalyst" may have less coke, a greater temperature, or both compared to spent FCC catalyst and may have greater catalytic activity compared to spent FCC catalyst. The "regenerated FCC catalyst" may have more coke and lesser catalytic activity compared to fresh FCC catalyst that has not passed through a cracking reaction zone and regenerator.

It should further be understood that streams may be named for the components of the stream, and the component for which the stream is named may be the major component of the stream (such as comprising from 50 weight percent (wt. %), from 70 wt. %, from 90 wt. %, from 95 wt. %, from 99 wt. %, from 99.5 wt. %, or even from 99.9 wt. % of the contents of the stream to 100 wt. % of the contents of the stream). It should also be understood that components of a stream are disclosed as passing from one system component to another when a stream comprising that component is disclosed as passing from that system component to another. For example, a disclosed "propylene stream" passing from a first system component to a second system component should be understood to equivalently disclose "propylene" passing from a first system component to a second system component, and the like.

The hydrocarbon feed stream 104 may generally comprise a hydrocarbon material. In embodiments, the hydrocarbon material of the hydrocarbon feed stream 104 may be crude oil. As used in this disclosure, the term "crude oil" is to be understood to mean a mixture of petroleum liquids, gases, or combinations of liquids and gases, including in some embodiments impurities such as sulfur-containing compounds, nitrogen-containing compounds and metal compounds that has not undergone significant separation or reaction processes. Crude oils are distinguished from fractions of crude oil. In certain embodiments the crude oil feedstock may be a minimally treated light crude oil to provide a crude oil feedstock having total metals (Ni+V) content of less than 5 parts per million by weight (ppmw) and Conradson carbon residue of less than 5 wt %.

Figure 2:
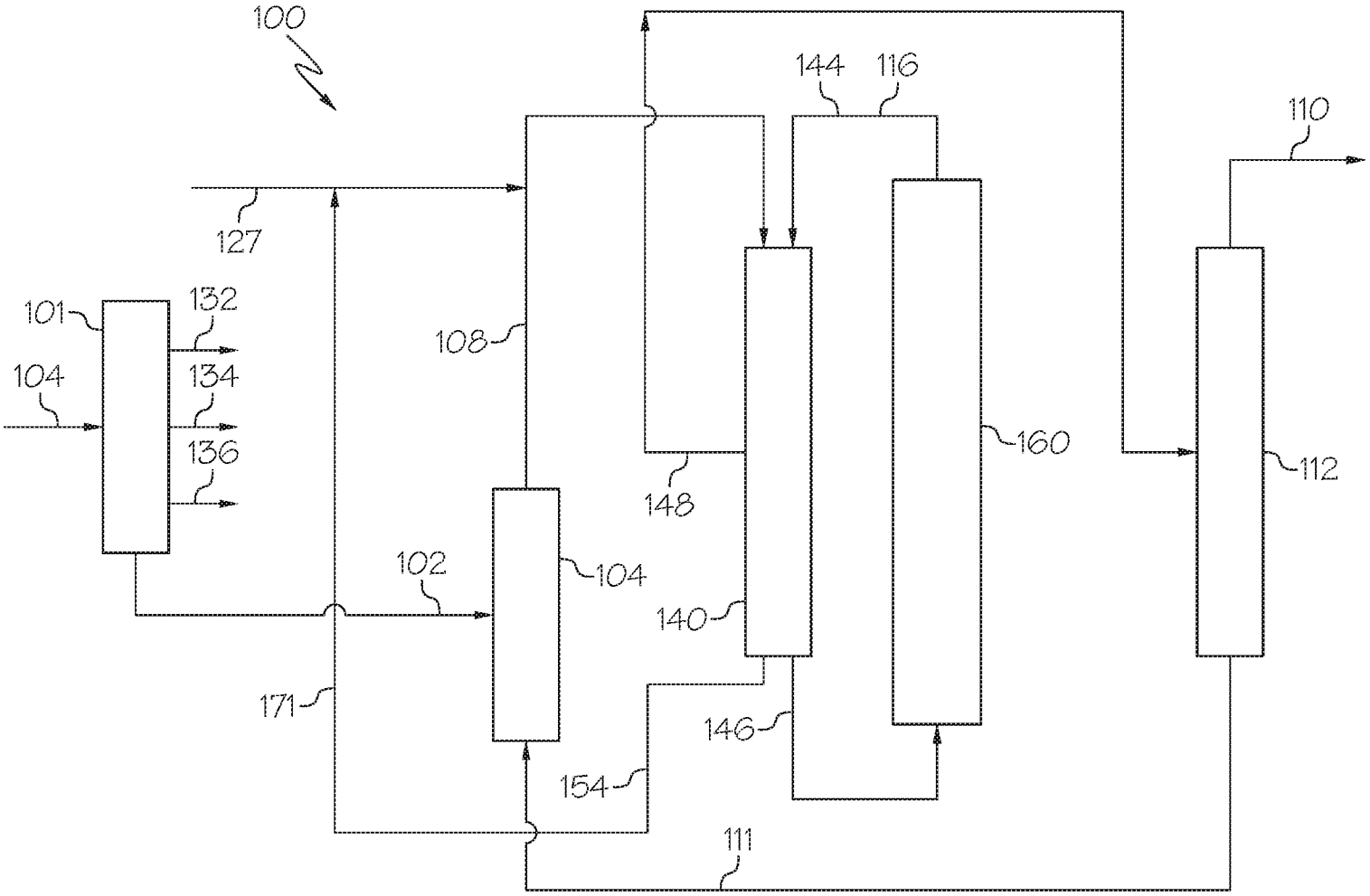
FIG. 2 is a generalized schematic diagram of an atmospheric residue conversion system, according to one or more embodiments described in this disclosure.
Figure 3:
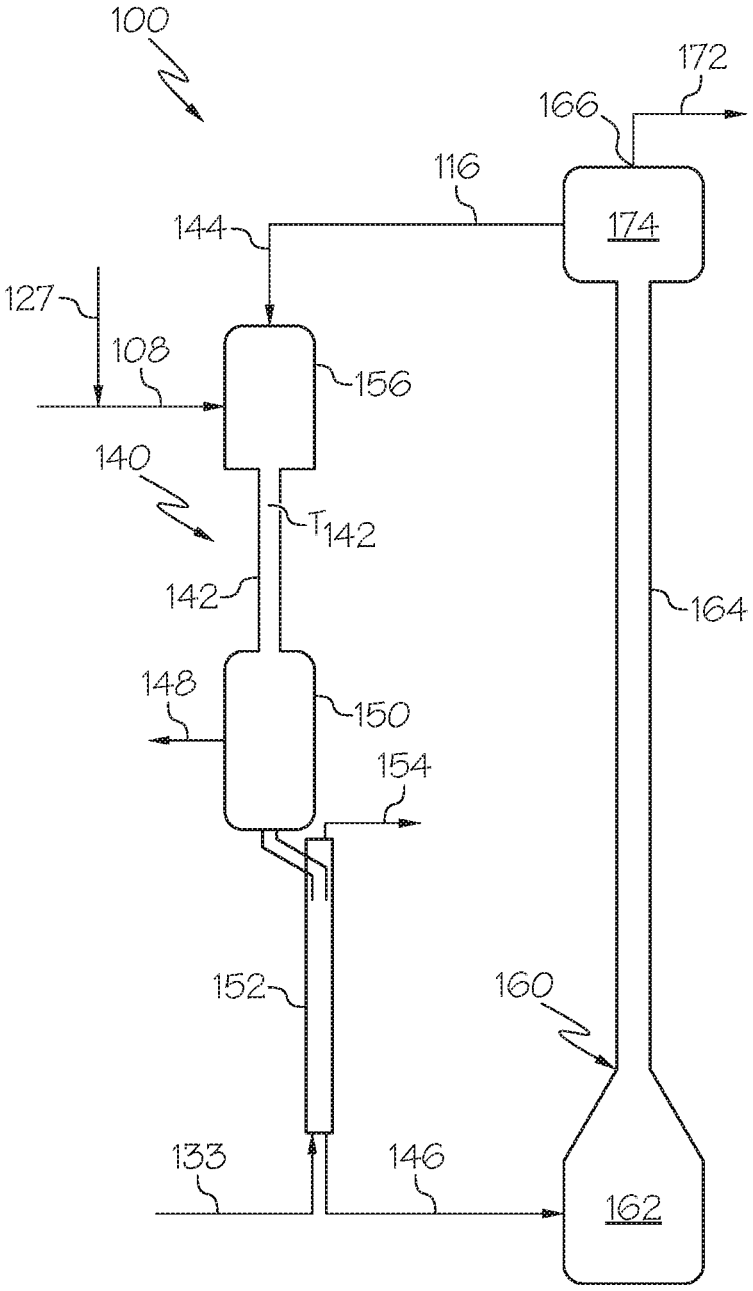
FIG. 3 depicts a schematic diagram of at least a portion of the atmospheric residue conversion system of FIG. 2 system, according to one or more embodiments described in this disclosure.

While the present description and examples may specify crude oil as the hydrocarbon material of the hydrocarbon feed stream 104, it should be understood that the atmospheric residue conversion systems 100 described with respect to the embodiments of FIGS. 2-3, respectively, may be applicable for the conversion of a wide variety of hydrocarbon materials, which may be present in the hydrocarbon feed stream 104, including, but not limited to, crude oil, vacuum residue, tar sands, bitumen, atmospheric residue, vacuum gas oils, demetalized oils, naphtha streams, other hydrocarbon streams, or combinations of these materials. The hydrocarbon feed stream 104 may include one or more non-hydrocarbon constituents, such as one or more heavy metals, sulphur compounds, nitrogen compounds, inorganic components, or other non-hydrocarbon compounds. If the hydrocarbon feed stream 104 is crude oil, it may have an American Petroleum Institute (API) gravity of from 22 degrees to 40 degrees. For example, the atmospheric residue stream 102 utilized may be an Arab heavy crude oil, Arab light crude oil, or Arab extra light crude oil. Example properties for one particular exemplary grade of Arab heavy crude oil are provided subsequently in Table 1. It should be understood that, as used in this disclosure, a "hydrocarbon feed" may refer to a raw hydrocarbon material which has not been previously treated, separated, or otherwise refined (such as crude oil) or may refer to a hydrocarbon material which has undergone some degree of processing, such as treatment, separation, reaction, purifying, or other operation, prior to being introduced to the atmospheric residue conversion system 100 in the hydrocarbon feed stream 104.

TABLE 1

Example of Arab Heavy Export Feedstock

| Analysis | Units | Value |
|---|---|---|
| American Petroleum Institute (API) gravity | degree | 27 |
| Density | grams per cubic centimeter ($g/cm^3$) | 0.8904 |

TABLE 1-continued

| Example of Arab Heavy Export Feedstock | | |
|---|---|---|
| Analysis | Units | Value |
| Sulfur Content | weight percent (wt. %) | 2.83 |
| Nickel | parts per million by weight (ppmw) | 16.4 |
| Vanadium | ppmw | 56.4 |
| Sodium Chloride (NaCl) Content | ppmw | <5 |
| Conradson Carbon Residue (CCR) | wt. % | 8.2 |
| $C_5$ Asphaltenes | wt. % | 7.8 |
| $C_7$ Asphaltenes | wt. % | 4.2 |

In general, the contents of the hydrocarbon feed stream 104 may include a relatively wide variety of chemical species based on boiling point. For example, the hydrocarbon feed stream 104 may have composition such that the difference between the 5 wt. % boiling point and the 95 wt. % boiling point of the atmospheric residue stream 102 is at least 100° C., at least 200° C., at least 300° C., at least 400° C., at least 500° C., or even at least 600° C.

Referring to FIG. 1, various hydrocarbon feed streams to be converted in a conventional FCC process are generally required to satisfy certain criteria in terms of the metals content and the Conradson Carbon Residue (CCR) or Ramsbottom carbon content. The CCR of a feed material is a measurement of the residual carbonaceous materials that remain after evaporation and pyrolysis of the feed material. Greater metals content and CCR of a feed stream may lead to more rapid deactivation of the catalyst. For greater levels of CCR, more energy may be needed in the regeneration step to regenerate the catalyst. For example, certain hydrocarbon feeds, such as residual oils, contain refractory components such as polycyclic aromatics which are difficult to crack and promote coke formation in addition to the coke formed during the catalytic cracking reaction. Because of the greater levels of CCR of these certain hydrocarbon feeds, the burning load on the regenerator is increased to remove the coke and residue from the spent catalysts to transform the spent catalysts to regenerated catalysts. This requires modification of the regenerator to be able to withstand the increased burning load without experiencing material failure. In addition, certain hydrocarbon feeds to the FCC may contain large amounts of metals, such as nickel, vanadium, or other metals for example, which may rapidly deactivate the catalyst during the cracking reaction process.

In general terms, the atmospheric residue conversion system 100 includes an FCC unit of which a portion of the atmospheric residue stream 102 contacts heated fluidized catalytic particles in a cracking reaction zone maintained at high-severity temperatures and pressures. When the portion of the atmospheric residue stream 102 contacts the hot catalyst and is cracked to lighter products, carbonaceous deposits, commonly referred to as coke, form on the catalyst. The coke deposits formed on the catalyst may reduce the catalytic activity of the catalyst or deactivate the catalyst. Deactivation of the catalyst may result in the catalyst becoming catalytically ineffective. The spent catalyst having coke deposits may be separated from the cracking reaction products, stripped of removable hydrocarbons, and passed to a regeneration process where the coke is burned from the catalyst in the presence of air to produce a regenerated catalyst that is catalytically effective. The term "catalytically effective" refers to the ability of the regenerated catalyst to increase the rate of cracking reactions. The term "catalytic activity" refers to the degree to which the regenerated catalyst increases the rate of the cracking reactions and may be related to a number of catalytically active sites available on the catalyst. For example, coke deposits on the catalyst may cover up or block catalytically active sites on the spent catalyst, thus, reducing the number of catalytically active sites available, which may reduce the catalytic activity of the catalyst. Following regeneration, the regenerated catalyst may have equal to or less than 10 wt. %, 5 wt. %, or even 1 wt. % coke based on the total weight of the regenerated catalyst. The combustion products may be removed from the regeneration process as a flue gas stream. The heated regenerated catalysts may then be recycled back to the cracking reaction zone of the FCC units.

Referring now to FIGS. 2 and 3, an atmospheric residue conversion system 100 is schematically depicted. The atmospheric residue conversion system 100 may be a high-severity fluid catalytic cracking (HSFCC) system. The atmospheric residue conversion system 100 generally receives an atmospheric residue stream 102 and directly processes the atmospheric residue stream 102 to produce one or more system product streams 110. The atmospheric residue conversion system 100 may include an atmospheric separation device 101, a hydrotreater 104, an FCC unit 140, and a regenerator 160.

The hydrocarbon feed stream 104 may be introduced to the atmospheric separation device 101, such as a distillation column, which may separate the contents of the hydrocarbon feed stream 104 into several fractions 132, 134, 136. These fractions 132, 134, 136, may include, for example, gases and distillates such as naphtha, kerosene, and diesel. The heaviest fraction separated in the atmospheric separation device 101 is referred to as the atmospheric residue, which exits in atmospheric residue stream 102. In one or more embodiments, the atmospheric separation device 101 operates at or near atmospheric pressure (such as, for example, from 1.2 to 1.5 atm). In such embodiments, the atmospheric residue stream 102 may contain hydrocarbons with a boiling point of greater than about 340° C. to about 350° C. (depending upon the exact pressure in the atmospheric separation device 101.) That is, the initial boiling point of the atmospheric residue stream 102 may be at least 340° C., at least 345° C., or at least 350° C. In general, atmospheric residue may contain hydrocarbons which cannot vaporize in the atmospheric separation device 101 because they begin to crack or otherwise break down at vaporization temperatures.

The atmospheric residue stream 102 may be passed from the atmospheric separation device 101 to the hydrotreating unit 104. The hydrotreating unit may hydrotreat the atmospheric residue stream to form a hydrotreated atmospheric residue stream 108. It should be understood that, while several specific embodiments of hydroprocessing catalysts are disclosed herein, the hydroprocessing catalysts and conditions are not necessarily limited in the embodiments presently described.

Hydrotreating atmospheric residue stream 102 may occur under conditions that substantially saturate the aromatic species, such that species like naphthalenes are converted to single ring aromatic species. The hydrotreated atmospheric residue stream 108 may have a greater propensity for cracking to light olefins (C2-C4). The hydrotreating process may convert unsaturated hydrocarbons, such as olefins and diolefins, to paraffins, which may easily be cracked to light olefins. Heteroatoms and contaminant species may also be removed by the hydrotreating process. These species may include sulfur, nitrogen, oxygen, halides, and certain metals.

The hydrotreating process may remove sulfur along with metal contaminants, nitrogen, which will help in prolonging catalyst activity and reduce Nitrogen Oxide ($NO_x$) emissions during catalyst regeneration. The hydrotreating process may reduce the amount of polyaromatics which are coke precursors. Feeds with high aromatic content also may act as coke precursors and usually have the tendency to produce more coke during catalytic cracking. The hydrotreating process may convert polyaromatics to single ring aromatics for easy cracking to light olefins. The hydrotreating process may maximize light olefins yield.

The hydrotreating unit 104 may improve the hydrogen content and cracking ability of the atmospheric residue stream 102. The hydrotreating process may remove one or more of at least a portion of nitrogen, sulfur, and one or more metals from the atmospheric residue stream 102, and may additionally break aromatic moieties in the atmospheric residue stream 102. According to one or more embodiments, the contents of the atmospheric residue stream 102 entering the hydrotreating unit 104 may have a relatively large amount of one or more of metals (for example, Vanadium, Nickel, or both), sulfur, and nitrogen. For example, the contents of the atmospheric residue stream 102 entering the hydrotreating unit 104 may comprise one or more of greater than 17 parts per million by weight of metals, greater than 135 parts per million by weight of sulfur, and greater than 50 parts per million by weight of nitrogen. The contents of the hydrotreated atmospheric residue stream 108 exiting the hydrotreating unit 104 may have a relatively small amount of one or more of metals (for example, Vanadium, Nickel, or both), sulfur, and nitrogen. For example, the contents of the hydrotreated atmospheric residue stream 108 exiting the hydrotreating unit 104 may comprise one or more of 17 parts per million by weight of metals or less, 135 parts per million by weight of sulfur or less, and 50 parts per million by weight of nitrogen or less.

The atmospheric residue stream 102 may be treated with a hydrodemetalization catalyst (referred to sometimes in this disclosure as an "HDM catalyst"), a transition catalyst, a hydrodenitrogenation catalyst (referred to sometimes in this disclosure as an "HDN catalyst"), and a hydrocracking catalyst. The HDM catalyst, transition catalyst, HDN catalyst, and hydrocracking catalyst may be positioned in series, either contained in a single reactor, such as a packed bed reactor with multiple beds, or contained in two or more reactors arranged in series.

The hydrotreating unit 104 may include multiple catalyst beds arranged in series. For example, the hydrotreating unit 104 may comprise one or more of one or more of an HDM reaction zone, a transition reaction zone, a HDN reaction zone, and a hydrocracking reaction zone. The hydrotreating unit 104 may comprise an HDM catalyst bed comprising an HDM catalyst in the HDM reaction zone, a transition catalyst bed comprising a transition catalyst in the transition reaction zone, an HDN catalyst bed comprising an HDN catalyst in the HDN reaction zone, and a hydrocracking catalyst bed comprising a hydrocracking catalyst in the hydrocracking reaction zone.

According to one or more embodiments, the atmospheric residue stream 102 may be introduced to the HDM reaction zone and be contacted by the HDM catalyst. Contact by the HDM catalyst with the atmospheric residue stream 102 may remove at least a portion of the metals present in the atmospheric residue stream 102. Following contact with the HDM catalyst, the atmospheric residue stream 102 may be converted to an HDM reaction effluent. The HDM reaction effluent may have a reduced metal content as compared to the contents of the atmospheric residue stream 102. For example, the HDM reaction effluent may have at least 70 wt. % less, at least 80 wt. % less, or even at least 90 wt. % less metal as the atmospheric residue stream 102.

According to one or more embodiments, the HDM reaction zone may have a weighted average bed temperature of from 350° C. to 450° C., such as from 370° C. to 415° C., and may have a pressure of from 30 bars to 200 bars, such as from 90 bars to 110 bars. The HDM reaction zone comprises the HDM catalyst, and the HDM catalyst may fill the entirety of the HDM reaction zone.

The HDM catalyst may comprise one or more metals from the International Union of Pure and Applied Chemistry (IUPAC) Groups 5, 6, or 8-10 of the periodic table. For example, the HDM catalyst may comprise molybdenum. The HDM catalyst may further comprise a support material, and the metal may be disposed on the support material. In one embodiment, the HDM catalyst may comprise a molybdenum metal catalyst on an alumina support (sometimes referred to as "$Mo/Al_2O_3$ catalyst"). It should be understood throughout this disclosure that metals that are contained in any of the disclosed catalysts may be present as sulfides or oxides, or even other compounds.

In one embodiment, the HDM catalyst may include a metal sulfide on a support material, where the metal is selected from the group consisting of IUPAC Groups 5, 6, and 8-10 elements of the periodic table, and combinations thereof. The support material may be gamma-alumina or silica/alumina extrudates, spheres, cylinders, beads, pellets, and combinations thereof.

In one embodiment, the HDM catalyst may comprise a gamma-alumina support, with a surface area of from 100 $m^2/g$ to 160 $m^2/g$ (such as, from 100 $m^2/g$ to 130 $m^2/g$, or from 130 $m^2/g$ to 160 $m^2/g$). The HDM catalyst can be best described as having a relatively large pore volume, such as at least 0.8 $cm^3/g$ (for example, at least 0.9 $cm^3/g$, or even at least 1.0 $cm^3/g$. The pore size of the HDM catalyst may be predominantly macroporous (that is, having a pore size of greater than 50 nm). This may provide a large capacity for the uptake of metals on the HDM catalyst's surface and optionally dopants. In one embodiment, a dopant can be selected from the group consisting of boron, silicon, halogens, phosphorus, and combinations thereof.

In one or more embodiments, the HDM catalyst may comprise from 0.5 wt. % to 12 wt. % of an oxide or sulfide of molybdenum (such as from 2 wt. % to 10 wt. % or from 3 wt. % to 7 wt. % of an oxide or sulfide of molybdenum), and from 88 wt. % to 99.5 wt. % of alumina (such as from 90 wt. % to 98 wt. % or from 93 wt. % to 97 wt. % of alumina).

Without being bound by theory, in some embodiments, it is believed that during the reaction in the HDM reaction zone, porphyrin type compounds present in the atmospheric residue stream 102 are first hydrogenated by the catalyst using hydrogen to create an intermediate. Following this primary hydrogenation, the nickel or vanadium present in the center of the porphyrin molecule may be reduced with hydrogen and then further reduced to the corresponding sulfide with hydrogen sulfide ($H_2S$). The final metal sulfide may be deposited on the catalyst thus removing the metal sulfide from the atmospheric residue stream 102. Sulfur may be also removed from sulfur containing organic compounds. This may be performed through a parallel pathway. The rates of these parallel reactions may depend upon the sulfur species being considered. Overall, hydrogen may be used to abstract the sulfur which is converted to $H_2S$ in the process.

The remaining, sulfur-free hydrocarbon fragment may remain in the atmospheric residue stream 102.

The HDM reaction effluent may be passed from the HDM reaction zone to the transition reaction zone where it is contacted by the transition catalyst. Contact by the transition catalyst with the HDM reaction effluent may remove at least a portion of the metals present in the HDM reaction effluent stream as well as may remove at least a portion of the nitrogen present in the HDM reaction effluent stream. Following contact with the transition catalyst, the HDM reaction effluent may be converted to a transition reaction effluent. The transition reaction effluent may have a reduced metal content and nitrogen content as compared to the HDM reaction effluent. For example, the transition reaction effluent may have at least 1 wt. % less, at least 3 wt. % less, or even at least 5 wt. % less metal content as the HDM reaction effluent. Additionally, the transition reaction effluent may have at least 10 wt. % less, at least 15 wt. % less, or even at least 20 wt. % less nitrogen as the HDM reaction effluent.

According to embodiments, the transition reaction zone may have a weighted average bed temperature of about 370° C. to 410° C. The transition reaction zone may comprise the transition catalyst, and the transition catalyst may fill the entirety of the transition reaction zone.

In one embodiment, the transition reaction zone may be operable to remove a quantity of metal components and a quantity of sulfur components from the HDM reaction effluent stream. The transition catalyst may comprise an alumina based support in the form of extrudates.

In one embodiment, the transition catalyst may comprise one metal from IUPAC Group 6 and one metal from IUPAC Groups 8-10. Example IUPAC Group 6 metals include molybdenum and tungsten. Example IUPAC Group 8-10 metals include nickel and cobalt. For example, the transition catalyst may comprise Mo and Ni on a titania support (sometimes referred to as "Mo—Ni/$Al_2O_3$ catalyst"). The transition catalyst may also contain a dopant that is selected from the group consisting of boron, phosphorus, halogens, silicon, and combinations thereof. The transition catalyst can have a surface area of 140 $m^2/g$ to 200 $m^2/g$ (such as from 140 $m^2/g$ to 170 $m^2/g$ or from 170 $m^2/g$ to 200 $m^2/g$). The transition catalyst can have an intermediate pore volume of from 0.5 $cm^3/g$ to 0.7 $cm^3/g$ (such as 0.6 $cm^3/g$). The transition catalyst may generally comprise a mesoporous structure having pore sizes in the range of 12 nm to 50 nm. These characteristics provide a balanced activity in HDM and HDS.

In one or more embodiments, the transition catalyst may comprise from 10 wt. % to 18 wt. % of an oxide or sulfide of molybdenum (such as from 11 wt. % to 17 wt. % or from 12 wt. % to 16 wt. % of an oxide or sulfide of molybdenum), from 1 wt. % to 7 wt. % of an oxide or sulfide of nickel (such as from 2 wt. % to 6 wt. % or from 3 wt. % to 5 wt. % of an oxide or sulfide of nickel), and from 75 wt. % to 89 wt. % of alumina (such as from 77 wt. % to 87 wt. % or from 79 wt. % to 85 wt. % of alumina).

The transition reaction effluent may be passed from the transition reaction zone to the HDN reaction zone where it is contacted by the HDN catalyst. Contact by the HDN catalyst with the transition reaction effluent may remove at least a portion of the nitrogen present in the transition reaction effluent stream. Following contact with the HDN catalyst, the transition reaction effluent may be converted to an HDN reaction effluent. The HDN reaction effluent may have a reduced metal content and nitrogen content as compared to the transition reaction effluent. For example, the HDN reaction effluent may have a nitrogen content reduction of at least 80 wt. %, at least 85 wt. %, or even at least 90 wt. % relative to the transition reaction effluent. In another embodiment, the HDN reaction effluent may have a sulfur content reduction of at least 80 wt. %, at least 90 wt. %, or even at least 95 wt. % relative to the transition reaction effluent. In another embodiment, the HDN reaction effluent may have an aromatics content reduction of at least 25 wt. %, at least 30 wt. %, or even at least 40 wt. % relative to the transition reaction effluent.

According to embodiments, the HDN reaction zone may have a weighted average bed temperature of from 370° C. to 410° C. The HDN reaction zone comprises the HDN catalyst, and the HDN catalyst may fill the entirety of the HDN reaction zone.

In one embodiment, the HDN catalyst may include a metal oxide or sulfide on a support material, where the metal is selected from the group consisting of IUPAC Groups 5, 6, and 8-10 of the periodic table, and combinations thereof. The support material may include gamma-alumina, mesoporous alumina, silica, or both, in the form of extrudates, spheres, cylinders and pellets.

According to one embodiment, the HDN catalyst may contain a gamma alumina based support that has a surface area of 180 $m^2/g$ to 240 $m^2/g$ (such as from 180 $m^2/g$ to 210 $m^2/g$, or from 210 $m^2/g$ to 240 $m^2/g$). This relatively large surface area for the HDN catalyst may allow for a smaller pore volume (for example, less than 1.0 $cm^3/g$, less than 0.95 $cm^3/g$, or even less than 0.9 $cm^3/g$). In one embodiment, the HDN catalyst may contain at least one metal from IUPAC Group 6, such as molybdenum and at least one metal from IUPAC Groups 8-10, such as nickel. The HDN catalyst can also include at least one dopant selected from the group consisting of boron, phosphorus, silicon, halogens, and combinations thereof. In one embodiment, cobalt can be used to increase desulfurization of the HDN catalyst. In one embodiment, the HDN catalyst may have a higher metals loading for the active phase as compared to the HDM catalyst. This increased metals loading may cause increased catalytic activity. In one embodiment, the HDN catalyst may comprise nickel and molybdenum, and has a nickel to molybdenum mole ratio (Ni/(Ni+Mo)) of 0.1 to 0.3 (such as from 0.1 to 0.2 or from 0.2 to 0.3). In an embodiment that includes cobalt, the mole ratio of (Co+Ni)/Mo may be in the range of 0.25 to 0.85 (such as from 0.25 to 0.5 or from 0.5 to 0.85).

According to another embodiment, the HDN catalyst may contain a mesoporous material, such as mesoporous alumina, that may have an average pore size of at least 25 nm. For example, the HDN catalyst may comprise mesoporous alumina having an average pore size of at least 30 nm, or even at least 35 nm. HDN catalysts with relatively small average pore size, such as less than 25 nm, may be referred to as conventional HDN catalysts in this disclosure, and may have relatively poor catalytic performance as compared with the larger pore-sized HDN catalysts presently disclosed. Embodiments of HDN catalysts which have an alumina support having an average pore size of from 2 nm to 50 nm may be referred to in this disclosure as "meso-porous alumina supported catalysts." In one or more embodiments, the mesoporous alumina of the HDM catalyst may have an average pore size in a range from 25 nm to 50 nm, from 30 nm to 50 nm, or from 35 nm to 50 nm. According to embodiments, the HDN catalyst may include alumina that has a relatively large surface area, a relatively large pore volume, or both. For example, the mesoporous alumina may have a relatively large surface area by having a surface area of at least about 225 $m^2/g$, at least about 250 $m^2/g$, at least about 275 $m^2/g$, at least about 300 $m^2/g$, or even at least about 350 $m^2/g$, such as from 225 $m^2/g$ to 500 $m^2/g$, from 200 $m^2/g$ to 450 $m^2/g$, or from 300 $m^2/g$ to 400 $m^2/g$. In one or more embodiments, the mesoporous alumina may have a relatively large pore volume by having a pore volume of at least about 1 mL/g, at least about 1.1 mL/g, at least 1.2 mL/g, or even at least 1.2 mL/g, such as from 1 mL/g to 5 mL/g, from 1.1 mL/g to 3, or from 1.2 mL/g to 2 mL/g. Without being bound by theory, it is believed that the meso-porous alumina supported HDN catalyst may provide additional active sites and larger pore channels that may facilitate larger molecules to be transferred into and out of the catalyst. The additional active sites and larger pore channels may result in higher catalytic activity, longer catalyst life, or both. In one embodiment, a dopant can be selected from the group consisting of boron, silicon, halogens, phosphorus, and combinations thereof.

According to embodiments described, the HDN catalyst may be produced by mixing a support material, such as alumina, with a binder, such as acid peptized alumina. Water or another solvent may be added to the mixture of support material and binder to form an extrudable phase, which is then extruded into a desired shape. The extrudate may be dried at an elevated temperature (such as above 100° C., such as 110° C.) and then calcined at a suitable temperature (such as at a temperature of at least 400° C., at least 450° C., such as 500° C.). The calcined extrudates may be impregnated with an aqueous solution containing catalyst precursor materials, such as precursor materials which include Mo, Ni, or combinations thereof. For example, the aqueous solution may contain ammonium heptanmolybdate, nickel nitrate, and phosphoric acid to form an HDN catalyst comprising compounds comprising molybdenum, nickel, and phosphorous.

In embodiments where a mesoporous alumina support is utilized, the mesoporous alumina may be synthesized by dispersing boehmite powder in water at 60° C. to 90° C. Then, an acid such as $HNO_3$ may be added to the boehmite is water solution at a ratio of $HNO_3$:$Al_3^+$ of 0.3 to 3.0 and the solution may be stirred at 60° C. to 90° C. for several hours, such as 6 hours, to obtain a sol. A copolymer, such as a triblock copolymer, may be added to the sol at room temperature, where the molar ratio of copolymer:Al is from 0.02 to 0.05 and aged for several hours, such as three hours. The sol/copolymer mixture may be dried for several hours and then calcined.

According to one or more embodiments, the HDN catalyst may comprise from 10 wt. % to 18 wt. % of an oxide or sulfide of molybdenum (such as from 13 wt. % to 17 wt. % or from 14 wt. % to 16 wt. % of an oxide or sulfide of molybdenum), from 2 wt. % to 8 wt. % of an oxide or sulfide of nickel (such as from 3 wt. % to 7 wt. % or from 4 wt. % to 6 wt. % of an oxide or sulfide of nickel), and from 74 wt. % to 88 wt. % of alumina (such as from 76 wt. % to 84 wt. % or from 78 wt. % to 82 wt. % of alumina).

In a similar manner to the HDM catalyst, and again not intending to be bound to any theory, it is believed that hydrodenitrogenation and hydrodearomatization may operate via related reaction mechanisms. Both may involve some degree of hydrogenation. For the hydrodenitrogenation, organic nitrogen compounds are usually in the form of heterocyclic structures, the heteroatom being nitrogen. These heterocyclic structures may be saturated prior to the removal of the heteroatom of nitrogen. Similarly, hydrodearomatization may involve the saturation of aromatic rings. Each of these reactions may occur to a differing amount on each of the catalyst types as the catalysts are selective to favor one type of transfer over others and as the transfers are competing.

It should be understood that some embodiments of the presently described methods and systems may utilize HDN catalyst that include porous alumina having an average pore size of at least 25 nm. However, in other embodiments, the average pore size of the porous alumina may be less than about 25 nm, and may even be microporous (that is, having an average pore size of less than 2 nm).

Still referring to FIG. 2, the HDN reaction effluent may be passed from the HDN reaction zone to the hydrocracking reaction zone where it is contacted by the hydrocracking catalyst. Contact by the hydrocracking catalyst with the HDN reaction effluent may reduce aromatic content present in the HDN reaction effluent. Following contact with the hydrocracking catalyst, the HDN reaction effluent may be converted to the hydrotreated atmospheric residue stream 108. The hydrotreated atmospheric residue stream 108 may have reduced aromatics content as compared to the HDN reaction effluent. For example, the hydrotreated atmospheric residue stream 108 may have at least 50 wt. % less, at least 60 wt. % less, or even at least 80 wt. % less aromatics content as the HDN reaction effluent.

The hydrocracking catalyst may comprise one or more metals from IUPAC Groups 5, 6, 8, 9, or 10 of the periodic table. For example, the hydrocracking catalyst may comprise one or more metals from IUPAC Groups 5 or 6, and one or more metals from IUPAC Groups 8, 9, or 10 of the periodic table. For example, the hydrocracking catalyst may comprise molybdenum or tungsten from IUPAC Group 6 and nickel or cobalt from IUPAC Groups 8, 9, or 10. The HDM catalyst may further comprise a support material, and the metal may be disposed on the support material, such as a zeolite. In one embodiment, the hydrocracking catalyst may comprise tungsten and nickel metal catalyst on a zeolite support that is mesoporous (sometimes referred to as "W—Ni/meso-zeolite catalyst"). In another embodiment, the hydrocracking catalyst may comprise molybdenum and nickel metal catalyst on a zeolite support that is mesoporous (sometimes referred to as "Mo—Ni/meso-zeolite catalyst").

According to some embodiments of the hydrocracking catalysts of the catalytic systems described in this disclosure, the support material (that is, the mesoporous zeolite) may be characterized as mesoporous by having average pore size of from 2 nm to 50 nm. Without being bound by theory, it is believed that the relatively large pore size (that is, mesoporosity) of the presently described hydrocracking catalysts allows for larger molecules to diffuse inside the zeolite, which is believed to enhance the reaction activity and selectivity of the catalyst. With the increased pore size, aromatic containing molecules can more easily diffuse into the catalyst and aromatic cracking may be increased. For example, zeolites with larger pore sizes (that is, mesoporous zeolites) may make the larger molecules of atmospheric residue stream 102 overcome the diffusion limitation, and may make possible reaction and conversion of the larger molecules of the atmospheric residue stream 102.

The zeolite support material is not necessarily limited to a particular type of zeolite. However, it is contemplated that zeolites such as Y, Beta, AWLZ-15, LZ-45, Y-82, Y-84, LZ-210, LZ-25, Silicalite, or mordenite may be suitable for use in the presently described hydrocracking catalyst. For example, suitable mesoporous zeolites which can be impregnated with one or more catalytic metals such as W, Ni, Mo, or combinations thereof, are described in at least U.S. Pat. No. 7,785,563; Zhang et al., Powder Technology 183 (2008)

73-78; Liu et al., Microporous and Mesoporous Materials 181 (2013) 116-122; and Garcia-Martinez et al., Catalysis Science & Technology, 2012 (DOI: 10.1039/c2cy00309k).

In one or more embodiments, the hydrocracking catalyst may comprise from 18 wt. % to 28 wt. % of a sulfide or oxide of tungsten (such as from 20 wt. % to 27 wt. % or from 22 wt. % to 26 wt. % of tungsten or a sulfide or oxide of tungsten), from 2 wt. % to 8 wt. % of an oxide or sulfide of nickel (such as from 3 wt. % to 7 wt. % or from 4 wt. % to 6 wt. % of an oxide or sulfide of nickel), and from 5 wt. % to 40 wt. % of mesoporous zeolite (such as from 10 wt. % to 35 wt. % or from 10 wt. % to 30 wt. % of zeolite). In another embodiment, the hydrocracking catalyst may comprise from 12 wt. % to 18 wt. % of an oxide or sulfide of molybdenum (such as from 13 wt. % to 17 wt. % or from 14 wt. % to 16 wt. % of an oxide or sulfide of molybdenum), from 2 wt. % to 8 wt. % of an oxide or sulfide of nickel (such as from 3 wt. % to 7 wt. % or from 4 wt. % to 6 wt. % of an oxide or sulfide of nickel), and from 5 wt. % to 40 wt. % of mesoporous zeolite (such as from 10 wt. % to 35 wt. % or from 10 wt. % to 30 wt. % of mesoporous zeolite).

The embodiments of the hydrocracking catalysts described may be fabricated by selecting a mesoporous zeolite and impregnating the mesoporous zeolite with one or more catalytic metals or by comulling mesoporous zeolite with other components. For the impregnation method, the mesoporous zeolite, active alumina (for example, boehmite alumina), and binder (for example, acid peptized alumina) may be mixed. An appropriate amount of water may be added to form a dough that can be extruded using an extruder. The extrudate may be dried at 80° C. to 120° C. for 4 hours to 10 hours, and then calcinated at 500° C. to 550° C. for 4 hours to 6 hours. The calcinated extrudate may be impregnated with an aqueous solution prepared by the compounds comprising Ni, W, Mo, Co, or combinations thereof. Two or more metal catalyst precursors may be utilized when two metal catalysts are desired. However, some embodiments may include only one of Ni, W, Mo, or Co. For example, the catalyst support material may be impregnated by a mixture of nickel nitrate hexahydrate (that is, $Ni(NO_3)_2.6H_2O$) and ammonium metatungstate (that is, $(NH_4)_6H_2W_{12}O_{40}$) if a W—Ni catalyst is desired. The impregnated extrudate may be dried at 80° C. to 120° C. for 4 hours to 10 hours, and then calcinated at 450° C. to 500° C. for 4 hours to 6 hours. For the comulling method, the mesoporous zeolite may be mixed with alumina, binder, and the compounds comprising W or Mo, Ni or Co (for example $MoO_3$ or nickel nitrate hexahydrate if Mo—Ni is desired).

It should be understood that some embodiments of the presently described methods and systems may utilize a hydrocracking catalyst that includes a mesoporous zeolite (that is, having an average pore size of from 2 nm to 50 nm). However, in other embodiments, the average pore size of the zeolite may be less than 2 nm (that is, microporous).

According to one or more embodiments described, the volumetric ratio of HDM catalyst:transition catalyst:HDN catalyst:hydrocracking catalyst may be 5-20:5-30:30-70:5-30 (such as a volumetric ratio of 5-15:5-15:50-60:15-20, or approximately 10:10:60:20.) The ratio of catalysts may depend at least partially on the metal content in the oil feedstock processed.

The hydrotreated atmospheric residue stream 108 may be passed from the hydrotreater 104 to the FCC unit 140. Steam 127 may be combined with the hydrotreated atmospheric residue stream 108 upstream of the cracking of the hydrotreated atmospheric residue stream 108. Steam 127 may act as a diluent to reduce a partial pressure of the hydrocarbons in the hydrotreated atmospheric residue stream 108. The steam:oil mass ratio of the combined mixture of steam 127 and stream 108 may be at least 0.5. In additional embodiments, the steam:oil ratio may be from 0.5 to 0.55, from 0.55 to 0.6, from 0.6 to 0.65, from 0.65 to 0.7, from 0.7 to 0.75, from 0.75 to 0.8, from 0.8 to 0.85, from 0.85 to 0.9, from 0.9 to 0.95, or any combination of these ranges.

Steam 127 may serve the purpose of lowering hydrocarbon partial pressure, which may have the dual effects of increasing yields of light olefins (e.g., ethylene, propylene and butylene) as well as reducing coke formation. Light olefins like propylene and butylene are mainly generated from catalytic cracking reactions following the carbonium ion mechanism, and as these are intermediate products, they can undergo secondary reactions such as hydrogen transfer and aromatization (leading to coke formation). Steam 127 may increase the yield of light olefins by suppressing these secondary bi-molecular reactions, and reduce the concentration of reactants and products which favor selectivity towards light olefins. The steam 127 may also suppress secondary reactions that are responsible for coke formation on catalyst surface, which is good for catalysts to maintain high average activation. These factors may show that a large steam-to-oil weight ratio is beneficial to the production of light olefins. However, the steam-to-oil weight ratio may not be enhanced infinitely in the practical industrial operating process, since increasing the amount of steam 127 will result in the increase of the whole energy consumption, the decrease of disposal capacity of unit equipment, and the inconvenience of succeeding condensation and separation of products. Therefore, the optimum steam:oil ratio may be a function of other operating parameters.

In some embodiments, steam 125 may also be used to preheat the hydrotreated atmospheric residue stream 108. Before the hydrotreated atmospheric residue stream 108 enters the FCC unit 140, the temperature of the hydrotreated atmospheric residue stream 108 may be increased by mixing with the steam 127. However, it should be understood that the temperature of the mixed steam and oil streams may be less than or equal to 250° C. Temperatures greater than 250° C. may cause fouling caused by cracking of the hydrotreated atmospheric residue stream 108. Fouling may lead to blockage of the reactor inlet. The reaction temperature (such as greater than 500° C.) may be achieved by using hot catalyst from the regeneration and/or fuel burners. That is, the steam 127 may be insufficient to heat the reactant streams to reaction temperatures, and may be ineffective in increasing the temperature by providing additional heating to the mixture at temperatures present inside of the reactors (e.g., greater than 500° C.). In general, the steam described herein in steam 127 is not utilized to increase temperature within the reactor, but rather to dilute the oils and reduce oil partial pressure in the reactor. Instead, the mixing of steam and oil may be sufficient to vaporize the oils at a temperature of less than 250° C. to avoid fouling.

The hydrotreated atmospheric residue stream 108 (which now includes steam 127) may be passed to a FCC unit 140 that includes a cracking reaction zone 142. The hydrotreated atmospheric residue stream 108 may be added to the catalyst/feed mixing zone 156. The hydrotreated atmospheric residue stream 108 may be mixed with a catalyst 144 and cracked to produce a spent catalyst 146 and a cracking reaction product stream 148. At least a portion of the hydrotreated atmospheric residue stream 108 may be cracked in the presence of steam 127 to produce the cracking reaction product stream 148. The spent second catalyst 146 may be separated from the second cracking reaction product stream 148 and passed to the regeneration zone 162 of the regenerator 160. The spent catalyst 146 may be regenerated in the regeneration zone 162 of the regenerator 160 to produce a regenerated catalyst 116. The regenerated catalyst 116 may have a catalytic activity that is at least greater than the catalytic activity of the spent catalyst 146. The regenerated catalyst 116 may then be passed back to the cracking reaction zone 142.

The cracking reaction product stream 148 may include a mixture of cracked hydrocarbon materials, which may be further separated into one or more greater value petrochemical products and recovered from the system in the one or more system product streams 110. For example, the cracking reaction product stream 148 may include one or more of mixed butenes, butadiene, propene, ethylene, other olefins, ethane, methane, other petrochemical products, or combinations of these. The hydrocarbon feed conversion system 100 may include a product separator 112. The cracking reaction product stream 148 may be introduced to the product separator 112 to separate this stream into a plurality of system product streams 110 (represented by a single arrow but possibly including two or more streams), cycle oil streams 111, or both system product streams 110 and cycle oil streams 111. Referring to FIGS. 2 and 3, the product separator 112 may be fluidly coupled to the first separation zone 130, the second separation zone 150, or both the separation zone 150. In embodiments, the stripped product stream 154 may be combined into the steam 127 comprising steam.

Referring to FIG. 2, the product separator 112 may be a distillation column or collection of separation devices that separates the cracking reaction product stream 148 into one or more system product streams 110, which may include one or more fuel oil streams, gasoline streams, mixed butenes stream, butadiene stream, propene stream, ethylene stream, ethane stream, methane stream, light cycle oil streams (LCO, 216-343° C.), heavy cycle oil streams (HCO, >343° C.), other product streams, or combinations of these. Each system product stream 110 may be passed to one or more additional unit operations for further processing, or may be sold as raw goods. As used in this disclosure, the one or more system product streams 110 may be referred to as petrochemical products, which may be used as intermediates in downstream chemical processing or packaged as finished products. The product separator 112 may also produce one or more cycle oil streams 111, which may be recycled to the hydrocarbon feed conversion system 100.

Generally, the cycle oil stream 111 may include the heaviest portions of the product stream 148. In one or more embodiments, at least 99 wt. % of the cycle oil stream 111 may have boiling points of at least 215° C. In some embodiments, the cycle oil stream 111 may be the fraction from the distillation of catalytic cracking product, which may boil in the range of from 215° C. to 371° C.

Still referring to FIG. 2, the cycle oil stream 111 may exit the product separator 112 and be passed to the hydrotreating unit 104. In other embodiments, the cycle oil stream 111 may be directly combined with the atmospheric residue stream 102 or the hydrotreated atmospheric residue stream 108.

Referring still to FIG. 3, the hydrotreated atmospheric residue stream 108 may be passed from the hydrotreating unit 104 to the FCC unit 140 (as shown in FIG. 2). The FCC unit 140 may include a catalyst/feed mixing zone 156, a cracking reaction zone 142, a separation zone 150, and a stripping zone 152. The hydrotreated atmospheric residue stream 108 may be introduced to the catalyst/feed mixing zone 156, where the hydrotreated atmospheric residue stream 108 may be mixed with the catalyst 144. During steady state operation of the hydrocarbon feed conversion system 100, the catalyst 144 may include at least the regenerated catalyst 116 that is passed to the catalyst/feed mixing zone 156 from a catalyst hopper 174. In embodiments, the catalyst 144 may be a mixture of spent catalyst 146 and regenerated catalyst 116. The catalyst hopper 174 may receive the regenerated catalyst 116 from the regenerator 160 following regeneration of the spent catalyst 146. At initial start-up of the hydrocarbon feed conversion system 100, the catalyst 144 may include fresh catalyst (not shown), which is catalyst that has not been circulated through the FCC unit 140 and the regenerator 160. In embodiments, fresh catalyst may also be introduced to catalyst hopper 174 during operation of the hydrocarbon feed conversion system 100 so that at least a portion of the catalyst 144 introduced to the catalyst/feed mixing zone 156 includes the fresh catalyst. Fresh catalyst may be introduced to the catalyst hopper 174 periodically during operation to replenish lost catalyst or compensate for spent catalyst that becomes permanently deactivated, such as through heavy metal accumulation in the catalyst.

In some embodiments, one or more supplemental feed streams (not shown) may be combined with the hydrotreated atmospheric residue stream 108 before introduction of the hydrotreated atmospheric residue stream 108 to the catalyst/feed mixing zone 156. In other embodiments, one or more supplemental feed streams may be added directly to the catalyst/feed mixing zone 156, where the supplemental feed stream may be mixed with the hydrotreated atmospheric residue stream 108 and the catalyst 144 prior to introduction into the cracking reaction zone 142. The supplemental feed stream may include one or more naphtha streams or other lesser boiling hydrocarbon streams.

The mixture comprising the hydrotreated atmospheric residue stream 108 and the catalyst 144 may be passed from the catalyst/feed mixing zone 156 to the cracking reaction zone 142. The mixture of the hydrotreated atmospheric residue stream 108 and catalyst 144 may be introduced to a top portion of the cracking reaction zone 142. The cracking reaction zone 142 may be a downflow reactor or "downer" reactor in which the reactants flow from the catalyst/feed mixing zone 156 downward through the cracking reaction zone 142 to the separation zone 150. Steam may be introduced to the top portion of the cracking reaction zone 142 to provide additional heating to the mixture of the hydrotreated atmospheric residue stream 108 and the catalyst 144. The hydrotreated atmospheric residue stream 108 may be reacted by contact with the catalyst 144 in the cracking reaction zone 142 to cause at least a portion of the hydrotreated atmospheric residue stream 108 to undergo at least one cracking reaction to form at least one cracking reaction product, which may include at least one of the petrochemical products previously described. The catalyst 144 may have a temperature equal to or greater than the cracking temperature $T_{142}$ of the cracking reaction zone 142 and may transfer heat to the hydrotreated atmospheric residue stream 108 to promote the endothermic cracking reaction.

It should be understood that the cracking reaction zone 142 of the FCC unit 140 depicted in FIG. 3 is a simplified schematic of one particular embodiment of the cracking reaction zone 142, and other configurations of the cracking reaction zone 142 may be suitable for incorporation into the hydrocarbon feed conversion system 100. For example, in some embodiments, the cracking reaction zone 142 may be an up-flow cracking reaction zone. Other cracking reaction zone configurations are contemplated. The FCC unit may be a hydrocarbon feed conversion unit in which in the cracking reaction zone 142, the fluidized catalyst 144 contacts the hydrotreated atmospheric residue stream 108 at high-severity conditions. The cracking temperature $T_{142}$ of the cracking reaction zone 142 may be from 500° C. to 800° C., from 500° C. to 700° C., from 500° C. to 650° C., from 500° C. to 600° C., from 550° C. to 800° C., from 550° C. to 700° C., from 550° C. to 650° C., from 550° C. to 600° C., from 600° C. to 800° C., from 600° C. to 700° C., or from 600° C. to 650° C. In some embodiments, the cracking temperature $T_{142}$ of the cracking reaction zone 142 may be from 500° C. to 700° C. In other embodiments, the cracking temperature $T_{142}$ of the cracking reaction zone 142 may be from 550° C. to 630° C. In some embodiments, the cracking temperature $T_{142}$ may be different than the first cracking temperature $T_{122}$.

A weight ratio of the catalyst 144 to the hydrotreated atmospheric residue stream 108 in the cracking reaction zone 142 (catalyst to hydrocarbon ratio) may be from 5:1 to 40:1, from 5:1 to 35:1, from 5:1 to 30:1, from 5:1 to 25:1, from 5:1 to 15:1, from 5:1 to 10:1, from 10:1 to 40:1, from 10:1 to 35:1, from 10:1 to 30:1, from 10:1 to 25:1, from 10:1 to 15:1, from 15:1 to 40:1, from 15:1 to 35:1, from 15:1 to 30:1, from 15:1 to 25:1, from 25:1 to 40:1, from 25:1 to 35:1, from 25:1 to 30:1, or from 30:1 to 40:1. The residence time of the mixture of catalyst 144 and the hydrotreated atmospheric residue stream 108 in the cracking reaction zone 142 may be from 0.2 seconds (sec) to 3 sec, from 0.2 sec to 2.5 sec, from 0.2 sec to 2 sec, from 0.2 sec to 1.5 sec, from 0.4 sec to 3 sec, from 0.4 sec to 2.5 sec, or from 0.4 sec to 2 sec, from 0.4 sec to 1.5 sec, from 1.5 sec to 3 sec, from 1.5 sec to 2.5 sec, from 1.5 sec to 2 sec, or from 2 sec to 3 sec.

Following the cracking reaction in the cracking reaction zone 142, the contents of effluent from the cracking reaction zone 142 may include catalyst 144 and the cracking reaction product stream 148, which may be passed to the separation zone 150. In the separation zone 150, the catalyst 144 may be separated from at least a portion of the cracking reaction product stream 148. In embodiments, the separation zone 150 may include one or more gas-solid separators, such as one or more cyclones. The catalyst 144 exiting from the separation zone 150 may retain at least a residual portion of the cracking reaction product stream 148.

After the separation zone 150, the catalyst 144 may be passed to the stripping zone 152, where at least some of the residual portion of the cracking reaction product stream 148 may be stripped from the catalyst 144 and recovered as a stripped product stream 154. The stripped product stream 154 may be passed to one or more than one downstream unit operations or combined with one or more than one other streams for further processing. Steam 133 may be introduced to the stripping zone 152 to facilitate stripping the cracking reaction product stream 148 from the catalyst 144. The stripped product stream 154 may include at least a portion of the steam 133 introduced to the stripping zone 152 and may be passed out of the stripping zone 152. The stripped product stream 154 may pass through cyclone separators (not shown) and out of the stripper vessel (not shown). The stripped product stream 154 may be directed to one or more product recovery systems in accordance with known methods in the art, such as recycled by combining with steam 127. The stripped product stream 154 may also be combined with one or more other streams, such as the cracking reaction product stream 148. Combination with other streams is contemplated. For example, the first stripped product stream 134, which may comprise a majority steam, may be combined with steam 127. In another embodiment, the first stripped product stream 134 may be separated into steam and hydrocarbons, and the steam portion may be combined with steam 127. The spent catalyst 146, which is the catalyst 144 after stripping out the stripped product stream 154, may be passed from the stripping zone 152 to the regeneration zone 162 of the regenerator 160.

The catalyst 144 used in the hydrocarbon feed conversion system 100 may include one or more fluid catalytic cracking catalysts that are suitable for use in the cracking reaction zone 142. The catalyst may be a heat carrier and may provide heat transfer to the hydrotreated atmospheric residue stream 108 in the cracking reaction zone 142 operated at high-severity conditions. The catalyst may also have a plurality of catalytically active sites, such as acidic sites for example, that promote the cracking reaction. For example, in embodiments, the catalyst may be a high-activity FCC catalyst having high catalytic activity. Examples of fluid catalytic cracking catalysts suitable for use in the hydrocarbon feed conversion system 100 may include, without limitation, zeolites, silica-alumina catalysts, carbon monoxide burning promoter additives, bottoms cracking additives, light olefin-producing additives, other catalyst additives, or combinations of these components. Zeolites that may be used as at least a portion of the catalyst for cracking may include, but are not limited to Y, REY, USY, RE-USY zeolites, or combinations of these. The catalyst may also include a shaped selective catalyst additive, such as ZSM-5 zeolite crystals or other pentasil-type catalyst structures, which are often used in other FCC processes to produce light olefins and/or increase FCC gasoline octane. In one or more embodiments, the catalyst may include a mixture of ZSM-5 zeolite crystals and the cracking catalyst zeolite and matrix structure of a typical FCC cracking catalyst. In one or more embodiments, the catalyst may be a mixture of Y and ZSM-5 zeolite catalysts embedded with clay, alumina, and binder.

In one or more embodiments, at least a portion of the catalyst may be modified to include one or more rare earth elements (15 elements of the Lanthanide series of the IUPAC Periodic Table plus scandium and yttrium), alkaline earth metals (Group 2 of the IUPAC Periodic Table), transition metals, phosphorus, fluorine, or any combination of these, which may enhance olefin yield in the first cracking reaction zone 122, cracking reaction zone 142, or both. Transition metals may include "an element whose atom has a partially filled d sub-shell, or which can give rise to cations with an incomplete d sub-shell" [IUPAC, Compendium of Chemical Terminology, 2nd ed. (the "Gold Book") (1997). Online corrected version: (2006-) "transition element"]. One or more transition metals or metal oxides may also be impregnated onto the catalyst. Metals or metal oxides may include one or more metals from Groups 6-10 of the IUPAC Periodic Table. In some embodiments, the metals or metal oxides may include one or more of molybdenum, rhenium, tungsten, or any combination of these. In one or more embodiments, a portion of the catalyst may be impregnated with tungsten oxide.

The regenerator 160 may include the regeneration zone 162, a catalyst transfer line 164, the catalyst hopper 174, and a flue gas vent 166. The catalyst transfer line 164 may be fluidly coupled to the regeneration zone 162 and the catalyst hopper 174 for passing the regenerated catalyst 116 from the regeneration zone 162 to the catalyst hopper 174. In some embodiments, the regenerator 160 may have more than one catalyst hopper 174, such as a first catalyst hopper (not shown) for the FCC unit 140, for example. In some embodiments, the flue gas vent 166 may be positioned at the catalyst hopper 174.

In operation, the spent catalyst 146 may be passed from the stripping zone 152 to the regeneration zone 162. Combustion gases may be introduced to the regeneration zone 162. The combustion gases may include one or more of combustion air, oxygen, fuel gas, fuel oil, other components, or any combinations of these. In the regeneration zone 162, the coke deposited on the spent catalyst 146 may at least partially oxidize (combust) in the presence of the combustion gases to form at least carbon dioxide and water. In some embodiments, the coke deposits on the spent catalyst 146 may be fully oxidized in the regeneration zone 162. Other organic compounds, such as residual first cracking reaction product or cracking reaction product for example, may also oxidize in the presence of the combustion gases in the regeneration zone. Other gases, such as carbon monoxide for example, may be formed during coke oxidation in the regeneration zone 162. Oxidation of the coke deposits produces heat, which may be transferred to and retained by the regenerated catalyst 116.

The flue gases 172 may convey the regenerated catalyst 116 through the catalyst transfer line 164 from the regeneration zone 162 to the catalyst hopper 174. The regenerated catalyst 116 may accumulate in the catalyst hopper 174 prior to passing from the catalyst hopper 174 to the first FCC unit 120 and the FCC unit 140. The catalyst hopper 174 may act as a gas-solid separator to separate the flue gas 172 from the regenerated catalyst 116. In embodiments, the flue gas 172 may pass out of the catalyst hopper 174 through a flue gas vent 166 disposed in the catalyst hopper 174.

The catalyst may be circulated through the FCC unit 140, the regenerator 160, and the catalyst hopper 174. The catalyst 144 may be introduced to the FCC unit 140 to catalytically crack the hydrotreated atmospheric residue stream 108 in the FCC unit 140. During cracking, coke deposits may form on the catalyst 144 to produce the spent catalyst 146 passing out of the stripping zone 152. The spent catalyst 146 also may have a catalytic activity that is less than the catalytic activity of the regenerated catalyst 116, meaning that the spent catalyst 146 may be less effective at enabling the cracking reactions compared to the regenerated catalyst 116. The spent catalyst 146 may be separated from the cracking reaction product stream 148 in the separation zone 150 and the stripping zone 152. The spent catalyst 146 may then be regenerated in the regeneration zone 162 to produce the regenerated catalyst 116. The regenerated catalyst 116 may be transferred to the catalyst hopper 174.

The regenerated catalyst 116 passing out of the regeneration zone 162 may have less than 1 wt. % coke deposits, based on the total weight of the regenerated catalyst 116. In some embodiments, the regenerated catalyst 116 passing out of the regeneration zone 162 may have less than 0.5 wt. %, less than 0.1 wt. %, or less than 0.05 wt. % coke deposits. In some embodiments, the regenerated catalyst 116 passing out of the regeneration zone 162 to the catalyst hopper 174 may have from 0.001 wt. % to 1 wt. %, from 0.001 wt. % to 0.5 wt. %, from 0.001 wt. % to 0.1 wt. %, from 0.001 wt. % to 0.05 wt. %, from 0.005 wt. % to 1 wt. %, from 0.005 wt. % to 0.5 wt. %, from 0.005 wt. % to 0.1 wt. %, from 0.005 wt. % to 0.05 wt. %, from 0.01 wt. % to 1 wt. %, from 0.01 wt. % to 0.5 wt. % to 0.01 wt. % to 0.1 wt. %, from 0.01 wt. % to 0.05 wt. % coke deposits, based on the total weight of the regenerated catalyst 116. In one or more embodiments, the regenerated catalyst 116 passing out of regeneration zone 162 may be substantially free of coke deposits. As used in this disclosure, the term "substantially free" of a component means less than 1 wt. % of that component in a particular portion of a catalyst, stream, or reaction zone. As an example, the regenerated catalyst 116 that is substantially free of coke deposits may have less than 1 wt. % of coke deposits. Removal of the coke deposits from the regenerated catalyst 116 in the regeneration zone 162 may remove the coke deposits from the catalytically active sites, such as acidic sites for example, of the catalyst that promote the cracking reaction. Removal of the coke deposits from the catalytically active sites on the catalyst may increase the catalytic activity of the regenerated catalyst 116 compared to the spent catalyst 146. Thus, the regenerated catalyst 116 may have a catalytic activity that is greater than the spent catalyst 146.

The regenerated catalyst 116 may absorb at least a portion of the heat generated from combustion of the coke deposits. The heat may increase the temperature of the regenerated catalyst 116 compared to the temperature of the spent catalyst 146. The regenerated catalyst 116 may accumulate in the catalyst hopper 174 until it is passed back to the FCC unit 140 as at least a portion of the catalyst 144. The regenerated catalyst 116 in the catalyst hopper 174 may have a temperature that is equal to or greater than the cracking temperature $T_{142}$ in the cracking reaction zone 142 of the FCC unit 140. The greater temperature of the regenerated catalyst 116 may provide heat for the endothermic cracking reaction in the cracking reaction zone 142.

EXAMPLES

The various embodiments of methods and systems for the conversion of a feedstock fuels will be further clarified by the following examples. The examples are illustrative in nature, and should not be understood to limit the subject matter of the present disclosure.

Example A

Example A provides an example of a process in which the crude oil is hydrotreated, much like cycle oil may be hydrotreated in the presently disclosed embodiments. The effect of hydrotreating is illustrated with atmospheric resid in Table 2.

TABLE 2

| Properties | Units | Non Hydrotreated Amospheric Resid | Hydrotreated Amospheric Resid |
|---|---|---|---|
| API | — | 14 | 21.7 |
| Density @ 15° C. | g/cm$^3$ | 0.9719 | 0.9231 |
| Nickel (Ni) | ppm (mg/kg) | 15.5 | 1.3 |
| Vanadium (V) | ppm (mg/kg) | 45.7 | 1.7 |
| Kinematic Viscosity @ 100° C. | cSt (mm$^2$/s) | 44.09 | 129.2 |
| Carbon residue | wt % | 10.35 | 3.28 |
| Nitrogen | ppm (mg/kg) | 1920 | 770 |
| Total Sulfur | wt % | 3.78 | 0.3 |

As shown in Table 2, the hydrotreating process removed sulfur, nitrogen, along with metal contaminants. Specifically, as described in Table 2, the hydrotreating process removed sulfur from 3.78 wt. % to 0.3 wt. %, nitrogen from 1920 ppm to 770 ppm, vanadium from 45.7 ppm to 1.7 ppm.

For the purposes of defining the present technology, the transitional phrase "consisting of" may be introduced in the claims as a closed preamble term limiting the scope of the claims to the recited components or steps and any naturally occurring impurities.

For the purposes of defining the present technology, the transitional phrase "consisting essentially of" may be introduced in the claims to limit the scope of one or more claims to the recited elements, components, materials, or method steps as well as any non-recited elements, components, materials, or method steps that do not materially affect the novel characteristics of the claimed subject matter.

The transitional phrases "consisting of" and "consisting essentially of" may be interpreted to be subsets of the open-ended transitional phrases, such as "comprising" and "including," such that any use of an open ended phrase to introduce a recitation of a series of elements, components, materials, or steps should be interpreted to also disclose recitation of the series of elements, components, materials, or steps using the closed terms "consisting of" and "consisting essentially of." For example, the recitation of a composition "comprising" components A, B and C should be interpreted as also disclosing a composition "consisting of" components A, B, and C as well as a composition "consisting essentially of" components A, B, and C.

Any quantitative value expressed in the present application may be considered to include open-ended embodiments consistent with the transitional phrases "comprising" or "including" as well as closed or partially closed embodiments consistent with the transitional phrases "consisting of" and "consisting essentially of."

It should be understood that any two quantitative values assigned to a property may constitute a range of that property, and all combinations of ranges formed from all stated quantitative values of a given property are contemplated in this disclosure. It should be appreciated that compositional ranges of a chemical constituent in a stream or in a reactor should be appreciated as containing, in some embodiments, a mixture of isomers of that constituent. For example, a compositional range specifying butene may include a mixture of various isomers of butene. It should be appreciated that the examples supply compositional ranges for various streams, and that the total amount of isomers of a particular chemical composition can constitute a range.

In a first aspect of the present disclosure, petrochemical products may be produced from a hydrocarbon material by a process that may comprise separating crude oil into at least two or more fractions in an atmospheric distillation column. One of the fractions may be an atmospheric residue. The process may further comprise hydrotreating the atmospheric residue to form a hydrotreated atmospheric residue; combining steam with the hydrotreated atmospheric residue such that the partial pressure of the hydrotreated atmospheric residue is reduced; and cracking at least a portion of the hydrotreated atmospheric residue in the presence of a first catalyst at a reaction temperature of from 500° C. to 700° C. to produce a cracking reaction product.

A second aspect of the present disclosure may include the first aspect where the cracking reaction product may comprise at least one of ethylene, propene, butene, or pentene.

A third aspect of the present disclosure may include either of the first or second aspects where the steam:oil mass ratio may be at least 0.5.

A fourth aspect of the present disclosure may include any of the first through third aspects where the process may further comprise separating cycle oil from the cracking reaction product; and recycling the cycle oil by combining the cycle oil with the atmospheric residue or hydrotreated atmospheric residue.

A fifth aspect of the present disclosure may include the fourth aspect where the cycle oil may be combined with the atmospheric residue in a hydrotreating unit wherein the hydrotreating of the atmospheric residue may take place.

A sixth aspect of the present disclosure may include any of the first through fifth aspects where the crude oil may have an API gravity of from 25° to 40°.

A seventh aspect of the present disclosure may include any of the first through sixth aspects where the hydrotreating of the atmospheric residue may remove at least a portion of metals, nitrogen, or aromatics content from the atmospheric residue to form the hydrotreated atmospheric residue.

An eighth aspect of the present disclosure may include any of the first through seventh aspects where steam may be combined with the hydrotreated atmospheric residue upstream of the cracking of the hydrotreated atmospheric residue.

A ninth aspect of the present disclosure may include any of the first through eighth aspects where the process may further comprise separating at least a portion of the cracking reaction product from a spent catalyst; and regenerating at least a portion of the spent catalyst to produce a regenerated catalyst.

A tenth aspect of the present disclosure may include any of the first through ninth aspects where the difference between the 5 wt. % boiling point and the 95 wt. % boiling point of the crude oil may be at least 100° C.

In an eleventh aspect of the present disclosure, petrochemical product stream may be produced from a hydrocarbon material by a process that may comprise separating a crude oil stream into at least two or more fractions in an atmospheric distillation column. One of the fractions may be an atmospheric residue stream. The process may further comprise hydrotreating the atmospheric residue stream to form a hydrotreated atmospheric residue stream; combining steam with the hydrotreated atmospheric residue stream such that the partial pressure of the hydrocarbons in the hydrotreated atmospheric residue stream may be reduced; and cracking at least a portion of the hydrotreated atmospheric residue stream in the presence of a first catalyst at a reaction temperature of from 500° C. to 700° C. to produce a cracking reaction product stream.

A twelfth aspect of the present disclosure may include the eleventh aspect where the cracking reaction product stream may comprise at least one of ethylene, propene, butene, or pentene.

A thirteenth aspect of the present disclosure may include either of the eleventh or twelfth aspects where the steam:oil mass ratio may be at least 0.5.

A fourteenth aspect of the present disclosure may include any of the eleventh through thirteenth aspects where the process may further comprise separating a cycle oil stream from the cracking reaction product stream; and recycling the cycle oil stream by combining the cycle oil stream with the atmospheric residue stream or hydrotreated atmospheric residue stream.

A fifteenth aspect of the present disclosure may include the fourteenth aspect where the cycle oil stream may be combined with the atmospheric residue stream in a hydrotreating unit wherein the hydrotreating of the atmospheric residue stream may take place.

A sixteenth aspect of the present disclosure may include any of the eleventh through fifteenth aspects where the crude oil stream may have an API gravity of from 25° to 40°.

A seventeenth aspect of the present disclosure may include any of the eleventh through sixteenth aspects where the hydrotreating of the atmospheric residue stream may remove at least a portion of metals, nitrogen, or aromatics content from the atmospheric residue stream to form the hydrotreated atmospheric residue stream.

An eighteenth aspect of the present disclosure may include any of the eleventh through seventeenth aspects where steam may be combined with the hydrotreated atmospheric residue stream upstream of the cracking of the hydrotreated atmospheric residue stream.

A nineteenth aspect of the present disclosure may include any of the eleventh through eighteenth aspects where the process may further comprise separating at least a portion of the cracking reaction product stream from a spent catalyst; and regenerating at least a portion of the spent catalyst to produce a regenerated catalyst.

A twentieth aspect of the present disclosure may include any of the eleventh through nineteenth aspects where the difference between the 5 wt. % boiling point and the 95 wt. % boiling point of the crude oil stream may be at least 100° C.

The subject matter of the present disclosure has been described in detail and by reference to specific embodiments. It should be understood that any detailed description of a component or feature of an embodiment does not necessarily imply that the component or feature is essential to the particular embodiment or to any other embodiment. Further, it should be apparent to those skilled in the art that various modifications and variations can be made to the described embodiments without departing from the spirit and scope of the claimed subject matter.

What is claimed is:

1. A process for producing petrochemical products from a hydrocarbon material, the process comprising:

separating crude oil into at least two or more fractions in an atmospheric distillation column, wherein one of the fractions is an atmospheric residue;

hydrotreating the atmospheric residue to form a hydrotreated atmospheric residue;

combining steam with the hydrotreated atmospheric residue such that the partial pressure of the hydrotreated atmospheric residue is reduced; and cracking at least a portion of the hydrotreated atmospheric residue in the presence of a first catalyst at a reaction temperature of from 500° C. to 700° C. to produce a cracking reaction product, wherein the steam: hydrotreated atmospheric residue mass ratio is at least 0.5.

2. The process of claim 1, wherein the cracking reaction product comprises at least one of ethylene, propene, butene, or pentene.

3. The process of claim 1, further comprising:

separating cycle oil from the cracking reaction product; and recycling the cycle oil by combining the cycle oil with the atmospheric residue or hydrotreated atmospheric residue.

4. The process of claim 3, wherein the cycle oil is combined with the atmospheric residue in a hydrotreating unit wherein the hydrotreating of the atmospheric residue takes place.

5. The process of claim 1, wherein the crude oil has an API gravity of from 25° to 40°.

6. The process of claim 1, wherein the hydrotreating of the atmospheric residue removes at least a portion of metals, nitrogen, or aromatics content from the atmospheric residue to form the hydrotreated atmospheric residue.

7. The process of claim 1, wherein steam is combined with the hydrotreated atmospheric residue upstream of the cracking of the hydrotreated atmospheric residue.

8. The process of claim 1, further comprising:

separating at least a portion of the cracking reaction product from a spent catalyst; and regenerating at least a portion of the spent catalyst to produce a regenerated catalyst.

9. The process of claim 1, wherein the difference between the 5 wt. % boiling point and the 95 wt. % boiling point of the crude oil is at least 100° C.

10. A process for producing a petrochemical product stream from a hydrocarbon material, the process comprising:

separating a crude oil stream into at least two or more fractions in an atmospheric distillation column, wherein one of the fractions is an atmospheric residue stream;

hydrotreating the atmospheric residue stream to form a hydrotreated atmospheric residue stream;

combining steam with the hydrotreated atmospheric residue stream such that the partial pressure of the hydrocarbons in the hydrotreated atmospheric residue stream is reduced; and cracking at least a portion of the hydrotreated atmospheric residue stream in the presence of a first catalyst at a reaction temperature of from 500° C. to 700° C. to produce a cracking reaction product stream, wherein the steam: hydrotreated atmospheric residue stream mass ratio is at least 0.5.

11. The process of claim 10, wherein the cracking reaction product stream comprises at least one of ethylene, propene, butene, or pentene.

12. The process of claim 10, further comprising:

separating a cycle oil stream from the cracking reaction product stream; and recycling the cycle oil stream by combining the cycle oil stream with the atmospheric residue stream or hydrotreated atmospheric residue stream.

13. The process of claim 12, wherein the cycle oil stream is combined with the atmospheric residue stream in a hydrotreating unit wherein the hydrotreating of the atmospheric residue stream takes place.

14. The process of claim 10, wherein the crude oil stream has an API gravity of from 25° to 40°.

15. The process of claim 10, wherein the hydrotreating of the atmospheric residue stream removes at least a portion of metals, nitrogen, or aromatics content from the atmospheric residue stream to form the hydrotreated atmospheric residue stream.

16. The process of claim 10, wherein steam is combined with the hydrotreated atmospheric residue stream upstream of the cracking of the hydrotreated atmospheric residue stream.

17. The process of claim 10, further comprising:

separating at least a portion of the cracking reaction product stream from a spent catalyst; and regenerating at least a portion of the spent catalyst to produce a regenerated catalyst.

18. The process of claim 10, wherein the difference between the 5 wt. % boiling point and the 95 wt. % boiling point of the crude oil stream is at least 100° C.

* * * * *